US010414999B2

(12) United States Patent
Carabell et al.

(10) Patent No.: US 10,414,999 B2
(45) Date of Patent: Sep. 17, 2019

(54) SYNERGISTIC LUBRICATING OIL COMPOSITION CONTAINING A MIXTURE OF OLEFIN COPOLYMER DISPERSANT-TYPE VISCOSITY IMPROVER AND AMINE COMPOUND

(71) Applicant: Chevron Oronite Company LLC, San Ramon, CA (US)

(72) Inventors: Kevin David Carabell, Fairfax, CA (US); John Robert Miller, San Rafael, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 15/411,123

(22) Filed: Jan. 20, 2017

(65) Prior Publication Data

US 2017/0211011 A1 Jul. 27, 2017

Related U.S. Application Data

(60) Provisional application No. 62/281,972, filed on Jan. 22, 2016.

(51) Int. Cl.

| | |
|---|---|
| ***C10M 161/00*** | (2006.01) |
| ***C10M 133/06*** | (2006.01) |
| ***C10M 133/40*** | (2006.01) |
| ***C10M 145/04*** | (2006.01) |

(52) U.S. Cl.

CPC ..... *C10M 161/00* (2013.01); *C10M 133/06* (2013.01); *C10M 133/40* (2013.01); *C10M 145/04* (2013.01); *C10M 2205/022* (2013.01); *C10M 2207/026* (2013.01); *C10M 2209/04* (2013.01); *C10M 2215/04* (2013.01); *C10M 2215/042* (2013.01); *C10M 2215/064* (2013.01); *C10M 2215/221* (2013.01); *C10M 2215/28* (2013.01); *C10M 2217/06* (2013.01); *C10M 2223/045* (2013.01); *C10M 2227/09* (2013.01); *C10N 2210/02* (2013.01); *C10N 2210/06* (2013.01); *C10N 2220/021* (2013.01); *C10N 2230/02* (2013.01); *C10N 2230/04* (2013.01); *C10N 2230/06* (2013.01); *C10N 2240/10* (2013.01); *C10N 2240/102* (2013.01)

(58) Field of Classification Search

CPC ..... C10M 161/00
USPC ..... 508/545, 262, 263, 562
See application file for complete search history.

(56) References Cited

U.S. PATENT DOCUMENTS

| | | | | |
|---|---|---|---|---|
| 2,421,837 | A | 6/1947 | Hardman | |
| 2,974,160 | A | 3/1961 | Heininger et al. | |
| 3,554,911 | A | 1/1971 | Schiff et al. | |
| 3,862,265 | A | 1/1975 | Steinkamp et al. | |
| 3,959,161 | A | 5/1976 | Dawans et al. | |
| 4,073,737 | A | 2/1978 | Elliott | |
| 4,137,185 | A | 1/1979 | Gardiner et al. | |
| 4,320,019 | A | 3/1982 | Hayashi | |
| 4,332,595 | A | 6/1982 | Herbstman et al. | |
| 4,804,794 | A | 2/1989 | Ver Strate et al. | |
| 4,863,623 | A | 9/1989 | Nalesnik | |
| 5,030,755 | A | 7/1991 | Ataka et al. | |
| 5,075,383 | A | 12/1991 | Migdal et al. | |
| 5,112,364 | A | 5/1992 | Rath et al. | |
| 5,348,673 | A | 9/1994 | Chung et al. | |
| 5,424,367 | A | 6/1995 | Auda et al. | |
| 5,523,008 | A | 6/1996 | Boden et al. | |
| 5,552,096 | A | 9/1996 | Auda et al. | |
| 5,565,161 | A | 10/1996 | Auda et al. | |
| 5,663,126 | A | 9/1997 | Boden et al. | |
| 5,669,939 | A | 9/1997 | Cherpeck | |
| 5,814,586 | A | 9/1998 | Boden et al. | |
| 5,837,773 | A | 11/1998 | Olivier et al. | |
| 5,874,389 | A | 2/1999 | Boden et al. | |
| 6,034,184 | A | 3/2000 | Coolbaugh et al. | |
| 6,107,257 | A * | 8/2000 | Valcho | C08F 255/00 508/221 |
| 6,117,825 | A | 9/2000 | Liu et al. | |
| 6,162,768 | A | 12/2000 | Coolbaugh et al. | |
| 6,211,332 | B1 | 4/2001 | Tanaglia | |
| 6,215,033 | B1 | 4/2001 | Coolbaugh et al. | |
| 6,248,702 | B1 | 6/2001 | Coolbaugh et al. | |
| 6,300,289 | B1 | 10/2001 | Boden et al. | |
| 6,362,286 | B1 | 3/2002 | Gardiner et al. | |
| 6,384,280 | B1 | 5/2002 | Cherpeck | |
| 6,410,652 | B1 * | 6/2002 | Goldblatt | C08F 255/00 525/263 |

(Continued)

FOREIGN PATENT DOCUMENTS

| | | |
|---|---|---|
| DE | 19711004 | 10/1997 |
| EP | 2816097 | 12/2014 |
| JP | 2592732 | 3/1997 |

OTHER PUBLICATIONS

Principles of Polymer Chemistry, Cornell University Press (1953), Chapter VII, pp. 266-316.
Macromolecules, an Introduction to Polymer Science, F. A. Bovey and F. H. Winslow, Editors, Academic Press (1979), pp. 296-312.
Encyclopedia of Polymer Science and Engineering, vol. 2, pp. 550-586.
Encyclopedia of Polymer Science and Engineering, vol. 8, pp. 499-532.

(Continued)

*Primary Examiner* — Ellen M McAvoy
(74) *Attorney, Agent, or Firm* — Ryan, Mason & Lewis LLP

(57) ABSTRACT

Disclosed is an internal combustion engine lubricating oil composition which comprises (a) a major amount of an oil of lubricating viscosity; (b) a dispersant-type olefin copolymer VI improver; and (c) a secondary hydrocarbylamine compound, a tertiary hydrocarbylamine compound, or combinations thereof. A method for reducing cam wear using same is also disclosed.

16 Claims, No Drawings

(56) References Cited

U.S. PATENT DOCUMENTS 6,486,352 B1 11/2002 Gray
6,649,800 B1 11/2003 Gray
6,686,321 B2 2/2004 Boden et al.
6,875,816 B2 4/2005 DeGroot et al.
6,942,342 B2 9/2005 Raasch
7,253,231 B2 8/2007 Devlin et al.
7,371,713 B2 * 5/2008 Goldblatt ..... C08F 8/30 508/221
7,485,603 B2 2/2009 Bera et al.
7,618,929 B2 * 11/2009 Tipton ..... C10M 141/06 508/287
7,786,057 B2 8/2010 Bera et al.
7,932,218 B2 * 4/2011 Chasan ..... C10M 133/40 252/401
7,947,636 B2 * 5/2011 Saathoff ..... C10M 141/06 508/291
7,999,039 B2 8/2011 DeGroot et al.
8,420,583 B2 * 4/2013 Boegner ..... C08F 255/00 508/287
9,115,237 B2 * 8/2015 McDougall ..... C08F 255/04
9,145,530 B2 9/2015 Bera et al.
2003/0150154 A1 8/2003 Cherpeck
2006/0084583 A1 4/2006 Tipton et al.
2006/0199896 A1 9/2006 Walton et al.
2008/0293600 A1 * 11/2008 Goldblatt ..... C08F 8/32 508/221
2009/0247706 A1 10/2009 Krista et al.
2010/0009880 A1 * 1/2010 Okada ..... C10M 141/10 508/438
2010/0152074 A1 6/2010 Nelson et al.
2012/0115765 A1 * 5/2012 Gutfrucht ..... C10M 133/08 508/562
2012/0323018 A1 * 12/2012 Goldblatt ..... C07D 207/40 548/545
2013/0228144 A1 * 9/2013 Makita ..... C10L 1/08 123/1 A
2013/0252865 A1 9/2013 Hartley et al.
2014/0024567 A1 * 1/2014 McDougall ..... C08F 255/04 508/238
2014/0051621 A1 * 2/2014 DeSantis ..... C10M 133/06 508/545
2014/0106996 A1 4/2014 DeSantis et al.
2015/0210952 A1 * 7/2015 Desantis ..... C10M 133/06 508/262
2016/0115419 A1 * 4/2016 Iwasaki ..... C10M 141/06 508/262
2017/0233673 A1 * 8/2017 Zweifel ..... C10M 107/34 508/562

OTHER PUBLICATIONS

Ham and Dermer, "Ethyleneimine and Other Aziridines", Academic Press, New York, 1969, pp. 224-227 and 256-257.

P. N. Rylander, Catalytic Hydrogenation in Organic Synthesis, Second Edition, pp. 138-152, Academic Press (1979).

H. F. Rase, Handbook of Commercial Catalysts, Heterogeneous Catalyst, pp. 138-148, CRC Press (2000).

* cited by examiner

SYNERGISTIC LUBRICATING OIL COMPOSITION CONTAINING A MIXTURE OF OLEFIN COPOLYMER DISPERSANT-TYPE VISCOSITY IMPROVER AND AMINE COMPOUND

FIELD OF THE DISCLOSURE

This invention is directed to performance improving additives for lubricating oils. In particular, the disclosure relates to a lubricating oil composition containing a particularly effective mixture of a dispersant-type viscosity improver and a secondary and/or tertiary amine compound for improving wear characteristics.

BACKGROUND OF THE DISCLOSURE

Hydrocarbon polymers, particularly ethylene-alpha olefin copolymers, are in widespread use as viscosity index (VI) improving additives for oil compositions, particularly lubricating oil compositions. A substantial body of prior art exists directed towards further reacting these ethylene-alpha olefin copolymer VI improvers to form a multi-functional VI improver.

This multi-functional VI Improver additive is used to improve not only the VI properties of the oil but often to also impart dispersancy so as to suspend soot or sludge that may form during the operation or use of the lubricant in engines. Other multi-functional VI improvers have also been reported to impart antiwear and antioxidant properties, both of which are very useful for sustained engine operation.

OEMs often set various limits for maximum sulfur, phosphorus, and/or sulfated ash levels for "new service fill" and "first fill" lubricants. For example, in some countries, when used in light-duty passenger-car internal combustion engines, the sulfur levels are typically required to be at or below 0.30 wt. %, the phosphorus levels at or below 0.08 wt. %, and the sulfated ash content at or below 0.8 wt. %. The maximum sulfur, phosphorus and/or sulfated ash levels may differ, however, when the lubricating compositions are used in heavy-duty internal combustion engines. For example, the maximum sulfated ash level may be as high as 1.6 wt. % in heavy-duty internal combustion engines. Such lubricating oil compositions are also referred to as "medium SAPS" (i.e., medium sulfated ash, phosphorus, and sulfur). When the maximum sulfated ash level is as high as 1.0 wt. %, the lubricating oil compositions are referred to as "low SAPS" lubricating oil compositions, e.g., for gasoline engines, and "LEDL" (i.e., low emission diesel lubricant) oil compositions for diesel engines. The lubricating oil composition must continue to provide the high levels of lubricant performance, including adequate detergency.

Historically, TBN has been provided by overbased detergents that introduce sulfated ash into the composition. It would be advantageous to provide a lubricating oil composition with a high level of TBN using a TBN boosting component that does not contribute sulfated ash. As highly basic components are known to induce corrosion and, in some cases reduce the compatibility between lubricating oil compositions and the fluoroelastomeric seal materials used in engines, it would be preferable to provide such a component that does not induce corrosion and, preferably, does not adversely affect seals compatibility. Tertiary amine compounds as well as hindered secondary amine compounds offer such a solution while at the same time increasing the TBN of lubricating oil compositions without introducing sulfated ash.

Thus, herein we report the synergistic combination of a dispersant-type viscosity improver and a tertiary amine compound for improving wear in an internal combustion engine.

This combination surprisingly showed improved cam wear characteristics compared to formulations without a tertiary amine compound.

DETAILED DESCRIPTION OF THE DISCLOSURE

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition. In the following description, all numbers disclosed herein are approximate values, regardless whether the word "about" or "approximate" is used in connection therewith. They may vary by 1 percent, 2 percent, 5 percent, or, sometimes, 10 to 20 percent.

As used herein, the terms "hydrocarbon", "hydrocarbyl" or "hydrocarbon based" mean that the group being described has predominantly hydrocarbon character within the context of this disclosure. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this disclosure, these groups may contain atoms other than, carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

It must be noted that as used in this specification and appended claims, the singular forms also include the plural unless the context clearly dictates otherwise. Thus the singular forms "a", "an", and "the" include the plural; for example, "an amine" includes mixtures of amines of the same type. As another example the singular form "amine" is intended to include both singular and plural unless the context clearly indicates otherwise.

In an aspect, the present disclosure provides a lubricating oil composition comprising:

a. a major amount of an oil of lubricating viscosity;

b. a dispersant-type olefin copolymer viscosity index improver; and c. a secondary hydrocarbylamine compound, a tertiary hydrocarbylamine compound, or combinations thereof.

In another aspect, the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight (Mn) between about 7,000 and about 500,000;

ii. an ethylenically unsaturated acylating agent; and iii. an aryloxy-alkylene amine of the formula Ar—O-Alk-$NH_2$, wherein Ar is an aromatic moiety selected from benzene, naphthylene or anthracene or optionally substituted benzene, optionally substituted naphthylene or optionally substituted anthracene, wherein the optionally substituted groups are selected from 1 to 3 substituent groups selected from alkyl, alkenyl, alkoxy, aryl, alkaryl, arylalkyl, aryloxy, wherein the alkyl group is a straight or branched chain carbon having 6 or less carbon atoms; and -Alk-comprises straight and branched chain alkylene groups having 1 to 10 carbon atoms, which may optionally be substituted with a group consisting of phenyl and benzyl; and c. a secondary hydrocarbylamine compound, a tertiary hydrocarbylamine compound, or combinations thereof.

In another aspect the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight (Mn) between about 7,000 and about 500,000;

ii. an ethylenically unsaturated acylating agent; and iii. an aryloxy-alkylene amine of the formula Ar—O-Alk-$NH_2$, wherein Ar is an aromatic moiety selected from benzene, naphthylene or anthracene or optionally substituted benzene, optionally substituted naphthylene or optionally substituted anthracene, wherein the optionally substituted groups are selected from 1 to 3 substituent groups selected from alkyl, alkenyl, alkoxy, aryl, alkaryl, arylalkyl, aryloxy, wherein the alkyl group is straight or branched chain carbon having 6 or less carbon atoms; and -Alk-comprises straight and branched chain alkylene groups having 1 to 10 carbon atoms, which may optionally be substituted with a group consisting of phenyl and benzyl; and c. a hindered secondary hydrocarbylamine compound.

In another aspect, the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight ($M_n$) between about 7,000 and about 500,000;

ii. an ethylenically unsaturated acylating agent; and iii. an aryloxy-alkylene amine of the formula Ar—O-Alk-$NH_2$, wherein Ar is an aromatic moiety selected from benzene, naphthylene or anthracene or optionally substituted benzene, optionally substituted naphthylene or optionally substituted anthracene, wherein the optionally substituted groups are selected from 1 to 3 substituent groups selected from alkyl, alkenyl, alkoxy, aryl, alkaryl, arylalkyl, aryloxy, wherein the alkyl group is a straight or branched chain carbon having 6 or less carbon atoms; and -Alk-comprises straight and branched chain alkylene groups having 1 to 10 carbon atoms, which may optionally be substituted with a group consisting of phenyl and benzyl; and c. a tertiary hydrocarbylamine compound.

In another aspect, the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight ($M_n$) between about 7,000 and about 500,000;

ii. an ethylenically unsaturated acylating agent; and iii. an aryl amine; and d. a secondary hydrocarbylamine compound, a tertiary hydrocarbylamine compound, or combinations thereof.

In another aspect, the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight ($M_n$) between about 7,000 and about 500,000;

ii. an ethylenically unsaturated acylating agent; and iii. an aryl amine; and c. a hindered secondary hydrocarbylamine compound.

In another aspect, the present disclosure provides a lubricating oil composition comprising:

a. a major amount of an oil of lubricating viscosity;

b. a dispersant-type viscosity index improver comprising the reaction product of:

i. a hydrocarbon polymer having a number average molecular weight ($M_n$) between about 7,000 and about 500,000;

ii. an ethylenically unsaturated acylating agent; and iii. an aryl amine; and c. a tertiary hydrocarbylamine compound.

Dispersant-Type VI Improver

Hydrocarbon Polymer as used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The hydrocarbon polymer is essentially a hydrocarbon based polymer, usually one having a number average molecular weight ($M_n$) between about 7,000 and about 500,000, often from about 20,000 to about 200,000, frequently from about 30,000 to about 100,000, about 30,000 to about 70,000, about 30,000 to about 60,000, and about 30,000 to about 50,000. Molecular weights of the hydrocarbon polymer are determined using well known methods described in the literature. Examples of procedures for determining the molecular weights are gel permeation chromatography (GPC) (also known as size-exclusion chromatography) and vapor phase osmometry (VPO). It is understood that these are average molecular weights. GPC molecular weights are typically accurate within about 5-10%. Even with narrow polydispersity, a polymer with $M_n$ of about 20,000 may have some species as low as about 15,000. A polymer with $M_n$ about 35,000 and $M_n$ about 20,000 may have GPC peaks corresponding to polymer components as low as about 10,000 and as high as 75,000.

These and other procedures are described in numerous publications including: P. J. Flory, "Principles of Polymer Chemistry", Cornell University Press (1953), Chapter VII, pp. 266-316, "Macromolecules, an Introduction to Polymer Science", F. A. Bovey and F. H. Winslow, Editors, Academic Press (1979), pp. 296-312, and W. W. Yau, J. J. Kirkland and D. D. Bly, "Modem Size Exclusion Liquid Chromatography", John Wiley and Sons, New York, 1979.

Unless otherwise indicated, GPC molecular weights referred to herein are polystyrene equivalent weights, i.e., are molecular weights determined employing polystyrene standards.

A measurement which is complementary to a polymer's molecular weight is the melt index (ASTM D-1238). Polymers of high melt index generally have low molecular weight, and vice versa. The polymers of the present disclosure preferably have a melt index of up to 100 dg/min., more preferably 5 to 15 dg/min when measured using ASTM D1238 condition L at 230° C. and 2.16 kg load.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673. Reducing molecular weight also tends to improve the subsequent shear stability of the polymer.

In preferred embodiments, the hydrocarbon polymer is at least one oil soluble or dispersible homopolymer or copolymer selected from the group consisting of: (1) polymers of aliphatic olefins having from 2 to about 28 carbon atoms; (2) polymers of dienes; (3) copolymers of conjugated dienes with vinyl substituted aromatic compounds; and (4) star polymers.

These preferred polymers are described in greater detail herein below.

(1) Polymers of Aliphatic Olefins

The hydrocarbon polymer may be one in which its main chain is composed essentially of aliphatic olefin, especially alpha olefin, monomers. The polyolefins of this embodiment thus exclude polymers which have a large component of other types of monomers copolymerized in the main polymer, such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible copolymers of ethylene and $C_3$ to $C_{28}$ alpha-olefins.

The olefin copolymer preferably has a number average molecular weight ($M_n$) determined by gel-permeation chromatography employing polystyrene standards, ranging from about 7,000 to about 500,000, often from about 20,000 to about 300,000, often from about 20,000 to about 200,000, more often from about 30,000 to about 100,000, even more often from about 30,000 to about 50,000. Exemplary polydispersity values ($M_w/M_n$) range from about 1.5 to about 10, often to about 3.0. Preferably from about 1.7, often from about 2.0 to about 2.5.

These polymers may be homopolymers or copolymers and are preferably polymers of alpha-olefins having from 2 to about 28 carbon atoms. Preferably they are copolymers, more preferably copolymers of ethylene and at least one other alpha-olefin having from 3 to about 28 carbon atoms, i.e., one of the formula $CH_2{=}CHR_a$ wherein $R_a$ is straight chain or branched chain alkyl radical comprising 1 to 26 carbon atoms. Preferably $R_a$ is alkyl of from 1 to 8 carbon atoms, and more preferably is alkyl of from 1 to 2 carbon atoms. Examples include homopolymers from monoolefins such as propylene, 1-butene, isobutene, 1-pentene, 1-hexene, 4-methyl-1-pentene, 1-heptene, 1-octene, 1-nonene, 1-decene, etc and copolymers, preferably of ethylene with one or more of these monomers. Preferably, the polymer of alpha-olefins is an ethylene-propylene copolymer. Another preferred olefin copolymer is an ethylene-1-butene copolymer.

The ethylene content of the copolymer is preferably in the range of 10 to 80 percent by weight, and more preferably 40 to 75 percent by weight. When propylene and/or 1-butene are employed as co-monomer(s) with ethylene, the ethylene content of such copolymers most preferably is 45 to 65 percent, more preferably in the range of 45 to 52 percent by weight although higher or lower ethylene contents may be present. Most preferably, these polymers are substantially free of ethylene homopolymer, although they may exhibit a degree of crystallinity due to the presence of small crystalline polyethylene segments within their microstructure. The polymer can be a blend of two or more homopolymers of different ethylene content in the range of 10 to 80 percent by weight. Such polymer blends can be made by mixing two or more polymers in a mixing device such as extruder; or by making the polymers in series reactors, where each reactor makes a homopolymer or copolymer.

In one particular embodiment, the polymer is a homopolymer derived from a butene, particularly, isobutylene. Especially preferred is where the polymer comprises terminal vinylidene olefinic double bonds.

Copolymers herein can include without limitation blends or reacted products of ethylene and one or more $C_3$ to $C_{28}$ alpha-olefins, and additionally optionally other dienes or polyenes and thus may herein also include terpolymers, and other higher forms. Other alpha-olefins suitable in place of propylene to form the copolymer or to be used in combination with ethylene and propylene to form a terpolymer include 1-butene, 1-pentene, 1-hexene, 1-octene and styrene; alpha-omega-diolefins such as 1,5-hexadiene, 1,6-heptadiene, 1,7-octadiene; branched chain alpha-olefins such as 4-methylbutene-1,5-methylpentene-1 and 6-methylheptene-1; vinyl substituted aromatic compounds such as styrene; and mixtures thereof. Methods for making the polymer substrate are also described, e.g., in U.S. Pat. Nos. 4,863,623, 5,075,383, and 6,107,257, which descriptions are incorporated herein by reference.

More complex polymer substrates, often designated as interpolymers, also may be used as the olefin polymer starting material, which may be prepared using a third component. The third component generally used to prepare an interpolymer substrate is a polyene monomer selected from nonconjugated dienes and trienes. The-non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, vinylnorbornene, 5-methylene-2-norborene, 1,5-heptadiene, and 1,6-octadiene. A mixture of more than one diene can be used in the preparation of the interpolymer. A preferred nonconjugated diene for preparing a terpolymer or interpolymer substrate is 1,4-hexadiene.

The triene component will have at least two nonconjugated double bonds, and up to about 30 carbon atoms in the chain. Typical trienes useful in preparing the interpolymer of the disclosure are 1-isopropylidene,-3α,4,7,7α-tetrahydroindene, 1-isopropylidenedicy clopentadiene, dihydroisodicyclopentadiene, and 2-(2-methylene-4-methyl-3-pentenyl) [2.2.1]bicyclo-5-heptene.

The polymerization reaction used to form an ethylene olefin copolymer substrate can generally be carried out in the presence of a catalyst system capable to polymerizing ethylene and other higher alpha-olefin and optionally a three or more monomers into the polymer or interpolymers described above. The typical catalyst systems used in such polymerizations are Ziegler-Natta or metallocene or other known catalyst systems such as dual catalyst system or chain shuttling catalyst. The Ziegler-Natta catalysts include many mixtures of halides of transition metals, especially titanium, chromium, vanadium, and zirconium, with organic derivatives of non-transition metals, particularly alkyl aluminum compounds. The terms "metallocene" and "metallocene catalyst precursor," as used herein, refer to compounds possessing a transition metal M, with cyclopentadienyl (Cp) ligands, at least one non-cyclopentadienyl-derived ligand X (e.g., a leaving group), and zero or one heteroatom-containing ligand Y, the ligands being coordinated to M and corresponding in number to the valence thereof. The metallocene catalyst precursors are generally neutral complexes but when activated with a suitable co-catalyst yield an active metallocene catalyst, which refers generally to an organometallic complex with a vacant coordination site that can coordinate, insert, and polymerize olefins. The metallocene catalyst precursor is preferably one of, or a mixture of metallocene compounds. Examples of the dual catalyst systems and chain shuttling catalyst can be found in at U.S. Pat. Nos. 7,999,039, 6,875,816 and 6,942,342, which hereby are incorporated as reference.

The polymerization reaction to form the polymer is generally carried out in the presence of a catalyst in a solvent medium. The polymerization solvent may be any suitable inert organic solvent that is liquid under reaction conditions for solution polymerization of monoolefins which is generally conducted in the presence of a Ziegler-Natta or metallocene type catalyst. Examples of satisfactory hydrocarbon solvents include straight chain paraffin's having from about 5 to about 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight-chain paraffinic hydrocarbons and aromatic hydrocarbons described above, are particularly suitable. The solvent selected may be a mixture of one or more of the foregoing hydrocarbons. It is desirable that the solvent be free of substances that will interfere with a Ziegler polymerization reaction.

The polymerization medium is not specific and can include solution, slurry, emulsion, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffin's having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

The polymers can be random copolymers, block copolymers, and random block copolymers. Ethylene propylene copolymers are usually random or statistical copolymers.

Random or statistical copolymers can be a mixture of two or more polymers made in two or more reactors in series. Block copolymers may be obtained by conducting the reaction in a tubular reactor. Such a procedure is described in U.S. Pat. No. 4,804,794 which is hereby incorporated by reference for relevant disclosures in this regard. These polymers are available commercially as PARATONE® 8941 and PARATONE® 8910 (marketed by Chevron Oronite Company L.L.C.). Block copolymers can also be obtained by selecting appropriate catalyst and/or process for the polymerization. Such polymers are described in U.S. Pat. Application No. 20060199896 which is hereby incorporated by reference for relevant disclosures in this regard. Such Olefin block copolymers are sold commercially by Dow Chemical's under trade name INFUSE™ olefin block copolymers.

Numerous United States patents, including the following, describe the preparation of copolymers of alpha olefins. Copolymers of ethylene with higher alpha olefins are the most common copolymers of aliphatic olefins. Ethylene-propylene copolymers are the most common ethylene-alpha-olefin copolymers and are preferred for use in this disclosure. A description of an ethylene-propylene copolymer appears in U.S. Pat. No. 4,137,185 which is hereby incorporated herein by reference.

Useful ethylene-alpha olefin, usually ethylene-propylene, copolymers are commercially available. Ethylene-alpha olefin copolymer comprising from about 30 to about 60 weight percent monomer units derived from ethylene are generally referred as low ethylene or amorphous copolymers. Ethylene alpha-olefin copolymer comprising from about 60 to about 80 weight percent units derived from ethylene are generally referred as high ethylene (semi-crystalline) polymers. The polymer substrate can also contain mixtures of amorphous and semi-crystalline polymers in weight ratios as described in U.S. Pat. No. 5,427,702 which hereby is incorporated by reference. The typical polymers available commercially that include amorphous copolymers are PARATONE® 8921 available from Chevron Oronite, LZ7067, LZ7065 and LZ7060 available from the Lubrizol Corporation, Keltan® 1200A, 1200B available from Lanxess and NDR125 available from Dow Chemical Company. The shear stability index (SSI) of the polymer substrate typically range from about 3 to about 60, more typically from about 5 to about 50, more preferably from about 10 to about 25. The thickening efficiency of the useful polymer substrate range from 0.4 to 4.0, more typically from 0.9 to about 3.2.

(2) Polymers of Dienes

The hydrocarbon polymer may be a homopolymer or copolymer of one or more dienes. The dienes may be conjugated such as isoprene, butadiene and piperylene or non-conjugated such as 1-4 hexadiene, ethylidene norbomene, vinyl norbomene, 4-vinyl cyclohexene, and dicyclopentadiene. Polymers of conjugated dienes are preferred. Such polymers are conveniently prepared via free radical and anionic polymerization techniques. Emulsion techniques are commonly employed for free radical polymerization.

As noted hereinabove, useful polymers have $M_n$ ranging from about 7,000 to about 500,000. More often, useful polymers of this type have $M_n$ ranging from about 20,000 to about 100,000.

These polymers may be and often are hydrogenated (optionally hydrogenated) to reduce the amount of olefinic unsaturation present in the polymer. They may or may not be exhaustively hydrogenated. Hydrogenation is often accomplished employing catalytic methods. Catalytic techniques employing hydrogen under high pressure and at elevated temperature are well-known to those skilled in the chemical art. Other methods are also useful and are well known to those skilled in the art.

Extensive discussions of diene polymers appear in the "Encyclopedia of Polymer Science and Engineering", Volume 2, pp. 550-586 and Volume 8, pp. 499-532, Wiley-Interscience (1986), which are hereby expressly incorporated herein by reference for relevant disclosures in this regard.

The polymers include homopolymers and copolymers of conjugated dienes including polymers of hydrocarbyl substituted 1,3-dienes preferably at least one substituent is hydrogen. Normally, the total carbon content of the diene will not exceed 20 carbons. Preferred dienes for preparation of the polymer are piperylene, isoprene, 2,3-dimethyl-1,3-butadiene, chloroprene and 1,3-butadiene. Suitable homopolymers of conjugated dienes are described, and methods for their preparation are given in numerous U.S. patents. As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. For example, U.S. Pat. No. 4,073,737 describes the preparation and hydrogenation of butadiene-isoprene copolymers.

(3) Copolymers of Conjugated Dienes with Vinyl Substituted Aromatic Compounds:

In one embodiment, the hydrocarbon polymer is a copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms.

Examples of vinyl-substituted aromatic compounds include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene and chlorostyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and 1,3-butadiene being particularly preferred. Mixtures of such conjugated dienes are useful.

The vinyl substituted aromatic content of these copolymers is typically in the range of about 15% to about 70% by weight, preferably about 20% to about 40% by weight. The aliphatic conjugated diene content of these copolymers is typically in the range of about 30% to about 85% by weight, preferably about 60% to about 80% by weight.

The polymers, and in particular, styrene-diene copolymers, can be random copolymers or block copolymers, which include regular block copolymers or random block copolymers. Random copolymers are those in which the co-monomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer. Block copolymers, particularly diblock copolymers are preferred. Examples of such polymer substrate is illustrated by U.S. Pat. Nos. 6,162,768; 6,215,033; 6,248,702 and 6,034,184 which is hereby incorporated by reference.

The random, regular block and random block polymers used in this disclosure may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. The sizes of the blocks are not necessarily the same, but may vary considerably. The only stipulation is that any regular block copolymer comprises relatively few, but relatively large, alternating homopolymer segments.

The copolymers can be prepared by methods well known in the art. Such copolymers usually are prepared by anionic polymerization using Group IA metals in the presence of electron-acceptor aromatics, or preformed organometallics such as sec-butyllithium as polymerization catalysts.

The styrene diene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group IA metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0). At this point, addition of 1,3-butadiene, isoprene or other suitable anionically polymerizable monomer to the homopolystyrene-lithium "living" polymer produces a second segment which grows from the terminal anion site to produce a living di-block polymer having an anionic terminus, with lithium gegenion.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer". When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, resulting in a "tapered block copolymer." An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis-addition.

These polymers may have considerable olefinic unsaturation, which may be reduced, if desired. Hydrogenation to reduce the extent of olefinic unsaturation may be carried out to reduce approximately 90-99.1% of the olefinic unsaturation of the initial polymer, such that from about 90 to about 99.9% of the carbon to carbon bonds of the polymer are saturated. In general, it is preferred that these copolymers contain no more than about 10%, preferably no more than 5% and often no more than about 0.5% residual olefinic unsaturation on the basis of the total amount of olefinic double bonds present in the polymer prior to hydrogenation. Unsaturation can be measured by a number of means well known to those of skill in the art, including infrared, nuclear magnetic resonance spectroscopy, bromine number, iodine number, and other means. Aromatic unsaturation is not considered to be olefinic unsaturation within the context of this disclosure.

Hydrogenation techniques are well known to those of skill in the art. One common method is to contact the copolymers with, hydrogen, often at superatmospheric pressure in the presence of a metal catalyst such as colloidal nickel, palladium supported on charcoal, etc. Hydrogenation may be carried out as part of the overall production process, using finely divided or supported, nickel catalyst. Other transition metals may also be used to effect the transformation. Other techniques are known in the art.

Other polymerization techniques such as emulsion polymerization can be used. Examples of suitable commercially available regular linear diblock copolymers as set forth above include SHELLVIS®-40, and SHELLVIS®-50, both hydrogenated styrene-isoprene block copolymers, manufactured by Shell Chemical. Examples of commercially available random block and tapered block copolymers include the various GLISSOVISCAL® styrene-butadiene copolymers manufactured by BASF.

The copolymers preferably have $M_n$ in the range of about 7000 to about 500,000, more preferably from about 20,000 to about 100,000. The weight average molecular weight ($M_w$) for these copolymers is generally in the range of about 10,000 to about 500,000, preferably from about 40,000 to about 200,000.

Copolymers of conjugated dienes with olefins containing aromatic groups, e.g., styrene, methyl styrene, etc. are described in numerous patents, for example, U.S. Pat. No. 3,554,911 describes a random butadiene-styrene copolymer, its preparation and hydrogenation.

(4) Star Polymer

Star polymers are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are often homopolymers and copolymers of dienes, preferably conjugated dienes, especially isoprene, vinyl substituted aromatic compounds such as monoalkenyl arenes, especially styrene, homopolymers of olefins such as butenes, especially isobutene, and mixtures thereof.

Molecular weights (GPC peak) of useful star polymers range from about 20,000, often from about 50,000 to about 700,000. They frequently have Mn ranging from about 50,000 to about 500,000.

The polymers thus comprise a poly(polyalkenyl coupling agent) nucleus with polymeric arms extending outward therefrom. The star polymers are usually hydrogenated such that at least 80% of the olefinic carbon-carbon bonds are saturated, more often at least 90% and even more preferably, at least 95% are saturated. As noted herein, the polymers contain olefinic unsaturation; accordingly, they are not exhaustively saturated before reaction with the carboxylic reactant.

The polyvinyl compounds making up the nucleus are illustrated by polyalkenyl arenes, e.g., divinyl benzene and poly vinyl aliphatic compounds.

Dienes making up the polymeric arms are illustrated by butadiene, isoprene and the like. Monoalkenyl compounds include, for example, styrene and alkylated derivatives thereof. In one embodiment, the arms are derived from dienes. In another embodiment, the arms are derived from dienes and vinyl substituted aromatic compounds. In yet another embodiment, the arms comprise polyisobutylene groups, often, isobutylene-conjugated diene copolymers. Arms derived from dienes or from dienes and vinyl substituted aromatic compounds are frequently substantially hydrogenated. Star polymers are well known in the art.

Mixtures of two or more hydrocarbon polymers may be used.

Grafting Procedure: Acylating Agents-Graft Monomers

A graft monomer is next grafted onto the polymer backbone of the polymer substrate to form an acylated hydrocarbon polymer backbone intermediate, such as an acylated ethylene-alphaolefin polymer.

Suitable graft monomers include ethylenically unsaturated carboxylic acid materials, such as unsaturated dicarboxylic acid anhydrides and their corresponding acids. These carboxylic reactants which are suitable for grafting onto the polymers contain at least one ethylenic bond and at least one carboxylic acid or its anhydride groups or a polar group which is convertible into said carboxyl groups by oxidation or hydrolysis. The carboxylic reactants are selected from the group consisting of acrylic, methacrylic, cinnamic, crotonic, maleic, fumaric and itaconic reactants or a mixture of two or more of these. In the case of unsaturated ethylene copolymers or terpolymers, itaconic acid or its anhydride is useful due to its reduced tendency to form a cross-linked structure during the free-radical grafting process.

In one aspect, the ethylenically unsaturated acylating agent can be represented by formula (A) and/or formula (B):

(A)

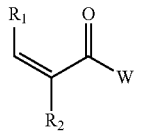

(B)

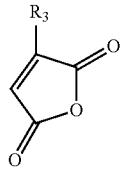

wherein $R_1$ is hydrogen or —CO—W', $R_2$ and $R_3$ are independently hydrogen or —$CH_3$; and W and W' are independently —OH, or alkoxyl having 1 to about 24 carbon atoms. Maleic anhydride or a derivative thereof is the preferred ethylenically unsaturated acylating agent.

The ethylenically unsaturated acylating agent may be grafted onto the copolymer backbone in a number of ways. It may be grafted onto the backbone by a thermal process known as the "ene" process or by grafting in solution or in melt form using a free-radical initiator. The free-radical induced grafting of ethylenically unsaturated acylating agents may carried out in solvents, such as hexane, heptane, mineral oil or aromatic solvents. It is carried out at an elevated temperature in the range of about 100° C. to about 250° C., preferably about 120° C. to about 190° C. and more preferably at about 150° C. to about 180° C., e.g. above 160° C., in a solvent preferably a mineral oil solution containing, e.g. about 1 wt % to about 50 wt %, preferably about 5 wt % to about 30 wt %, based on the initial total oil solution, of the polymer and preferably under an inert environment.

The ethylenically unsaturated carboxylic acid materials typically can provide one or two carboxylic groups per mole of reactant to the grafted copolymer. That is, methyl methacrylate can provide one carboxylic group per molecule to the grafted copolymer while maleic anhydride can provide two carboxylic groups per molecule to the grafted copolymer.

Free-Radical Initiator

The grafting reaction to form the acylated copolymers is in one embodiment generally carried out with the aid of a free-radical initiator either in bulk or in solution. The grafting can be carried out in the presence of a free-radical initiator dissolved in oil. The use of a free-radical initiator dissolved in oil results in a more homogeneous distribution of acylated groups over the olefin copolymer molecules.

The free-radical initiators which may be used to graft the ethylenically unsaturated carboxylic acid material to the polymer backbone include peroxides, hydroperoxides, peresters, and also azo compounds and preferably those which have a boiling point greater than 100 and decompose thermally within the grafting temperature range to provide free radicals. Representatives of these free-radical initiators are peroxides (diacyl peroxides such as benzoyl peroxide, dialkyl peroxides such as 1,1-bis(tert-butylperoxy)cyclohexane. 1,1-bis(tert-butylperoxy)-3,3,5-trimethylcyclohexane, 2,2-bis(tert-butylperoxy)butane, dicumylperoxide, tert-butylcumylperoxide, bis(tert-butylperoxyisopropyl) benzene, di-tert-butylperoxide (DTBP), 2,5-dimethyl-2,5-di (tert-butylperoxy)hexane, 2,5-dimethyl-2,5-di(tert-butylperoxy)-hexyne), hydroperoxides, peroxyesters such as tert-butyl peroxy benzoate, tert-butylperoxy acetate, O,O-tert-butyl—O-(2-ethylhexyl)monoperoxy carbonate, peroxketals such as n-butyl 4,4-di-(tert-butylperoxy)valerate and the like. The initiator is used in an amount of between about 0.005% and about 1% by weight based on the weight of the reaction mixture solution. The grafting is preferably carried out in an inert atmosphere, such as under nitrogen blanketing. The resulting polymer intermediate is characterized by having acylating group, typified by a carboxylic acid or acid chloride, within its structure.

Grafting Reaction Equipment and Conditions

To perform the grafting reaction as bulk process, the graft monomer and copolymer are in one embodiment fed to an extruder, e.g., a single or twin screw extruder e.g. Werner & Pfleiderer's ZSK series, or a Banbury or other mixer, having the capability of heating and effecting the desired level of mechanical work (agitation) on the reactants for the grafting step.

In one embodiment, one can conduct grafting in an extruder, such as a twin-screw extruder. A nitrogen blanket is maintained at the feed section of the extruder to minimize the introduction of air. In another embodiment, the olefinic carboxylic acylating agent can be injected at one injection point, or is alternatively injected at two injection points in a zone of the extruder without significant mixing e.g. a transport zone. This results in an improved efficiency of the grafting and leads to a lower gel content.

Suitable extruders are generally known available for conducting grafting, and the prior dehydration procedure. The dehydration of the polymer substrate and subsequent grafting procedures can be performed in separate extruders set up in series. Alternatively, a single extruder having multiple treatment or reaction zones can be used to sequentially conduct the separate operations within one piece of equipment. Illustrations of suitable extruders are set forth, e.g., in U.S. Pat. Nos. 3,862,265 and 5,837,773, which descriptions are incorporated herein by reference.

In forming the acylated olefin copolymers, the olefin copolymer generally is fed into processing equipment such as an extruder, intensive mixer or masticator, heated to a temperature of at least 60° C., for example, 150° to 240° C., and the ethylenically unsaturated carboxylic acid reagent and free-radical initiator are separately co-fed to the molten copolymer to effect grafting. The reaction is carried out optionally with mixing conditions to effect grafting of the olefin copolymers. Molecular weight reduction and grafting can be performed simultaneously, illustrative mixing conditions are described in U.S. Pat. No. 5,075,383, which are incorporated herein by reference. The processing equipment is generally purged with nitrogen to prevent oxidation of the copolymer and to aid in venting unreacted reagents and byproducts of the grafting reaction. The residence time in the processing equipment is controlled to provide for the desired degree of acylation and to allow for purification of the acylated copolymer via venting. Mineral or synthetic lubricating oil may optionally be added to the processing equipment after the venting stage to dissolve the acylated copolymer. Other polymer backbones may be processed similarly.

The grafting reaction can be carried out in solvent-free or essentially solvent free environment. The grafting reaction preferably is performed in the absence of hydrocarbon solvents. The avoidance of hydrocarbon solvents during the grafting reaction, such as alkanes (e.g., hexane), eliminates or significantly reduces the risk and problem of undesired side reactions of such solvents during the grafting reaction which can form undesired grafted alkyl succinic anhydride by-products and impurities. Also, reduced amounts of transient unfunctionalized polymer (ungrafted polymer) are present after grafting in solventless grafting reactions, which results in a more active product. Therefore, the resulting copolymer intermediate is a more active product. A reduction is achieved in levels of undesirable grafted solvent (i.e., grafted hexyl succinic anhydride) and transient unfunctionalized (nongrafted) copolymer.

Hydrocarbon solvents can be omitted according to certain embodiments of the present disclosure include solvents that generally are more volatile than the reactants of the grafting reaction described herein, for example, solvents having a boiling point less than about 150° C. under standard atmospheric pressure conditions (i.e., approximately 14.7 lb./int absolute). The solvents that can be omitted include, for example, open-chain aliphatic compounds such as $C_9$ or lower alkanes, alkenes and alkynes (e.g., $C_5$ to $C_8$ alkanes such as hexane); aromatic hydrocarbons (e.g., compounds having a benzene nucleus such as benzene and toluene); alicyclic hydrocarbons such as saturated cyclic hydrocarbons (e.g., cyclohexane); ketones; or any combinations of these. In one embodiment, it is desirable to omit all solvents having boiling points approximating or lower than that of nonane under standard atmospheric conditions. Some conventional grafting reactions have been performed in the presence of considerable amounts of hydrocarbon solvent, such as approximately 15% to 60% hexane content. By comparison, in one embodiment of the present disclosure, the total amount of these types of such solvents in the grafting reaction mass does not exceed 0.5 wt. % content thereof.

The grafted copolymer intermediate exits from the die face of the extruder either immediately after grafting, or after shearing and vacuum stripping (discussed below in more detail) if performed in different sections of the same extruder or a separate extruder arranged in series with the extruder in which grafting is conducted.

Selected Properties of Copolymer Intermediate

The resulting copolymer intermediate comprises an acylated copolymer characterized by having carboxylic acid acylating functionality randomly within its structure. The amount of carboxylic acid acylating agent (e.g., maleic anhydride) that is grafted onto the prescribed copolymer backbone (i.e., the copolymer substrate) is important. This parameter is referred to as the mass percentage of acylating agent on the acylated copolymer and generally is in the range of 0.5 to 3.0 wt. %, particularly in the range of 1.5 to 2.5 wt. %, and more particularly in the range of 1.7 to 2.3 wt. %, of carboxylic acid acylating agent grafted on the copolymer backbone. These numbers are more representative of the amount of carboxylic acid acylating agent being maleic anhydride and may be adjusted to account for agents having higher or lower molecular weights or greater or lesser amounts of acid functionality per molecule.

The wt. % of carboxylic acylating agent incorporated into the backbone can be determined either by infrared peak ratio analysis of acid or anhydride moiety versus copolymer alkyl functionality or by titration (Total Acid/Anhydride Number) (TAN) of the additive reaction product. The TAN value in turn can be used to estimate the degree of grafting of the carboxylic agent.

The carboxylic reactant is grafted onto the prescribed copolymer backbone to provide 0.15 to 0.75 carboxylic groups per 1000 number average molecular weight units (Mn) of the copolymer backbone, preferably 0.2 to 0.5 carboxylic groups per 1000 number average molecular weight. For example, a copolymer substrate with Mn of 20,000 is grafted with 3 to 15 carboxylic groups per copolymer chain or 1.5 to 7.5 moles of maleic anhydride per mole of copolymer. A copolymer with Mn of 100,000 is grafted with 15 to 75 carboxylic groups per copolymer chain or 7.5 to 37.5 moles of maleic anhydride per copolymer chain. The minimum level of functionality is the level needed to achieve the minimum satisfactory dispersancy and/or wear performance.

Molecular Weight Reduction of Copolymer Intermediate

The molecular weight of the acylated copolymer, i.e., the copolymer intermediate, may be reduced by mechanical, thermal, or chemical means, or a combination thereof. Techniques for degrading or reducing the molecular weight of such copolymers are generally known in the art. The number average molecular weight is reduced to suitable level for use in single grade or multigrade lubricating oils. In one embodiment, the initial copolymer intermediate has an initial number average molecular weight ranging from about 1,000 to about 500,000 upon completion of the grafting reaction. In one embodiment, to prepare an additive intended for use in multigrade oils, the copolymer intermediate's number average molecular weight is reduced down to a range of about 1,000 to about 80,000.

Alternatively, grafting and reduction of the high molecular weight copolymer may be done simultaneously. In another alternative, the high molecular weight copolymer may be first reduced to the prescribed molecular weight before grafting. As a representative example, when the olefin copolymer's average molecular weight is reduced before grafting, its number average molecular weight is sufficiently reduced to a value below about 80,000, e.g., in the range of about 1,000 to 80,000.

Reduction of the molecular weight of the copolymer intermediate, or the copolymer feed material during or prior to or after grafting, to a prescribed lower molecular weight typically is conducted in the absence of a solvent or in the presence of a base oil, using either mechanical, thermal, or chemical means, or combination of these means. Generally, the copolymer intermediate, or copolymer such as olefin copolymer, is heated to a molten condition at a temperature in the range of about 150° C. to about 350° C. and it is then subjected to mechanical shear, thermally or chemical induced cleavage or combination of said means, until the copolymer intermediate (or olefin copolymer) is reduced to the prescribed molecular weight. The shearing may be effected within an extruder section, such as described, e.g., in U.S. Pat. No. 5,837,773, which descriptions are incorporated herein by reference. The molecular weight reduction can be achieved by treatment of the free radical initiators or hydroperoxide as described, e.g., in U.S. Pat. No. 6,211,332, which descriptions are incorporated herein by reference. The molecular weight reduction can also be achieved, optionally in presence of base oils, in the presence of oxygen at specified temperature as described, e.g., in U.S. Pat. No. 6,362,286, which descriptions are incorporated herein by reference. Alternatively, mechanical shearing may be conducted by forcing the molten copolymer intermediate (or olefin copolymer) through fine orifices under pressure or by other mechanical means.

Vacuum Stripping of Unreacted Ingredients

Upon completion of the grafting reaction, unreacted carboxylic reactant and free radical initiator usually are removed and separated from the copolymer intermediate before further functionalization is performed on the copolymer intermediate. The unreacted components may be eliminated from the reaction mass by vacuum stripping, e.g., the reaction mass may be heated to temperature of about 150° C. to about 300° C. under agitation with a vacuum applied for a period sufficient to remove the volatile unreacted graft monomer and free radical initiator ingredients. Vacuum stripping preferably is performed in an extruder section equipped with venting means.

Pelletization of Copolymer Intermediate

The copolymer intermediate can be optionally pelletized before further processing in accordance with embodiments of the disclosure herein. Pelletization of the copolymer intermediate helps to isolate the intermediate product and reduce contamination thereof until further processing is conducted thereon at a desired time. Alternatively, further reaction to form the final imidized polymer can be done further without pelletizing the intermediate (discussed in more details in section below).

The copolymer intermediate can generally be formed into pellets by a variety of process methods commonly practiced in the art of plastics processing. These include underwater pelletization, ribbon or strand pelletization or conveyor belt cooling. When the strength of the copolymer is inadequate to form into strands, the preferred method is underwater pelletization. Temperatures during pelletization generally may not exceed 30° C. Optionally, a surfactant can be added to the cooling water during pelletization to prevent pellet agglomeration.

The mixture of water and quenched copolymer pellets is conveyed to a dryer such as a centrifugal drier for removal of water. Pellets can be collected in a box or plastic bag at any volume for storage and shipment. Under some conditions of storage and/or shipment at ambient conditions, pellets may tend to agglomerate and stick together. These can be readily ground by mechanical methods to provide high surface area solid pieces for easy and quick dissolution into oil.

Dissolution and Functionalization of Pelletized Copolymer Intermediate

Optionally, the pelletized copolymer intermediate may be supplied as an unground or ground form of the pellets. The pelletized acylated copolymer intermediate is dissolved in solvent neutral oil. The pellets generally are dissolved in the solvent at an introduction level of from about 5 wt. % to about 25 wt. %, particularly about 10 wt. % to about 15 wt. %, and more particularly about 12 wt. % to about 13 wt. % of the copolymer, based on the resulting solution (solute and solvent) viscosity.

The pelletized copolymer intermediate can be dissolved in the solvent neutral at temperature of, for example, about 120° C. to about 165° C. with mechanical stirring under a nitrogen blanket. The dissolving mixture is sparged with inert gas during the dissolution for about 2 to 16 hours. This treatment can be performed in a continuous stirred process vessel of suitable capacity.

The inert sparging gas can be nitrogen. The dissolution and sparging, if used, can be prior to the subsequent amination procedure. One or more spargers are located within the vessel at locations submerged beneath the surface of the solution, preferably near the bottom of the solution, and bubble inert gas through the solution. Nitrogen sparging removes moisture from the dissolved copolymer intermediate and solvent oil. Importantly, the removal of moisture from the copolymer intermediate acts to convert any polymeric dicarboxylic diacids present back to the desired copolymeric dicarboxylic anhydride form.

For instance, where maleic anhydride is used as the grafting monomer, some portion of the pelletized copolymer intermediate may inadvertently transform to a copolymeric succinic diacid form. In general, this change is more apt to occur as a function of a longer shelf life. The conducting of nitrogen sparging during dissolution of the copolymer intermediate and prior to amination has the benefit of converting the copolymeric succinic diacid back into the desired active polymeric succinic anhydride form before the copolymer intermediate is further reacted and functionalized (e.g., aminated). Consequently, a more highly functionalized and active aminated product can be obtained in subsequent processing. The conversion of polymeric succinic diacid present back into the active polymeric succinic anhydride form can be monitored by measuring the viscosity of the solution. The solution viscosity decreases significantly from an initial higher value down to a steady-state value upon conversion of all or essentially all of the polymeric succinic diacid back into the desired polymeric succinic anhydride form.

Alternate Processes to Prepare the Functionalized Polymer Intermediate

The acylated copolymer can be further reacted with the aryloxy-alkaline amine compounds of this disclosure in an extruder or mixing devices without being pelletized and/or dissolved in oil. Such process to carry out multi-reaction step in an extruder is described in more details in U.S. Pat. Nos. 5,424,367; 5,552,096; 5,565,161 which hereby is incorporated by reference. Such process can be carried out in a series extruder system such as described in U.S. Pat. Application No. 2009247706 which hereby is incorporated by reference. Alternatively, the functionalized polymer can be made using two pass process in an extruder, wherein the first pass produces acylated copolymer intermediate which is fed to an second extruder, optionally connected to the first extruder, as an polymer melt or pellets to carry out further reaction with the aryloxy-alkylene amine of the present disclosure. This process offers advantages by eliminating the dissolving of the acylated polymer intermediate in an mineral oil to carry out amination reaction.

One more way to carry out the present disclosure is the form a graft monomer intermediate by first reacting an acylating agent with an aryloxy-alkylene amine of the present disclosure to form a reaction product. The reaction product may include more than one chemical compound formed from the combination of the acylating agent and the aryloxy-alkylene amine. The formed reaction product is then grafted to the polymer substrate in solution or in the melt process described above. This eliminates the needs to carry out amination reaction on the acylated polymer substrate. Such process is disclosed in U.S. Pat. Nos. 7,371,713; 6,410,652; 6,686,321; 5,523,008; 5,663,126; 6,300,289; 5,814,586; 5,874,389 which hereby are incorporated as reference.

Aryloxyalkylene Amine

The aryloxy-alkylene amine is suitably an alkylene mono primary amine. By employing only one primary amine function it avoids coupling and/or gelling of copolymers. The alkylene group comprises straight and branched chain alkylene groups having 1 to 10 carbon atoms, with ethylene, propylene, beta substituted ethylene and beta substituted propylene, wherein the substituent groups are lower alkyl selected from 1 to 6 carbon atoms, phenyl and benzyl. The aromatic core moiety is meant to include both mononuclear and polynuclear groups wherein the mononuclear and polynuclear groups may optionally be substituted with one to three substituents. The polynuclear groups can be of the fused type wherein the aromatic nuclear group is fused at two points to another nucleus such as found in naphthyl or anthranyl groups. The aromatic group may also be the linked type wherein at least two nuclei (either mononuclear or polynuclear) are linked through bridging linkages to each other. These bridging linkages can be chosen from, among others known to those skilled in the art, direct carbon to carbon bonds between the groups without any intervening atoms, alkylene linkages, ether linkages, ester linkages, keto linkages, sulfur linkages and the like. In a preferred aspect, the aromatic group contains at least two aromatic groups either fused or linked. Examples of particularly suited aromatic core groups are derived from benzene, naphthylene and anthracene containing carboxylic groups wherein the aromatic core group is differentiated from an optional substituent. Each of these various aromatic groups may also be substituted by various substituents, including hydrocarbyl substituents.

In a general aspect, the aryloxy-alkylene amine is of the formula Ar—O-Alk-$NH_2$ wherein Ar is an aromatic moiety selected from benzene, naphthylene or anthracene or optionally substituted benzene, optionally substituted naphthylene or optionally substituted anthracene, with the optionally substituted groups selected from 1 to 3 substituent groups selected from alkyl, alkenyl, alkoxy, aryl, alkaryl, arylalkyl, aryloxy, wherein preferably the alkyl group is straight or branched chain carbon having less than 8 carbon atoms, less than 6 carbon atoms, and more preferably alkyl is from $C_1$ to $C_6$. When the substituent group is aryl, alkaryl, arylalkyl, aryloxy the aromatic groups is may be referred to as linked. Particularly preferred aryl groups are phenyl or naphthyl. Preferred arylalkyl groups include the groups in which one hydrogen of the alkyl group is substituted with an aryl group and include, for example benzyl, phenethyl, phenpropyl, napthylmethyl, naphthylethyl, naphthylpropyl. Preferred aryloxy groups include phenoxy and naphthyloxy particularly 1-naphthyloxy and 2-naphthyloxy. The -Alk- group comprises straight and branched chain alkylene groups having 1 to 10 carbon atoms, with ethylene, propylene, beta substituted ethylene and beta substituted propylene, wherein the substituent groups are lower alkyl selected from 1 to 6 carbon atoms, phenyl, and benzyl.

The preferred alkylene group comprises straight and branched chain alkylene groups and optionally substituted alkylene having 2 up to 10 carbon atoms, with ethylene, propylene, beta substituted ethylene and beta substituted propylene particularly preferred (in this regard, beta is in reference to the oxygen of Ar—O— group. In one aspect, Alk is —$CH_2CH(R^4)$— wherein $R^4$ is selected from the group consisting of hydrogen, a straight or branched chain alkyl from $C_1$ to $C_6$, phenyl or a benzyl group e.g. a phenylmethylene group. In one aspect, -Alk- is —$CH_2CH(R^5)CH_2$— wherein $R^5$ is hydrogen or methyl group.

Methods for preparing the aryloxy-alkylene amine compounds are known to those skilled in the art, and such compounds may be prepared by numerous methods such as employed to prepare phenoxyethylamines and polyalkylphenoxyaminoalkanes or as known in the art. U.S. Pat. No. 5,030,755 discloses a method for producing substituted phenoxyethylamines by reducing a substituted phenoxyacetaldehyde oxime with hydrogen in the presence of a Raney-nickel catalyst.

Polyalkylphenoxyaminoalkanes are known fuel additives useful in the prevention and control of engine deposits. U.S. Pat. No. 5,669,939 describes a process for preparing these compounds which involves initially hydroxylating a polyalkylphenol with an alkylene carbonate in the presence of a catalytic amount of an alkali metal hydride or hydroxide, or alkali metal salt, to provide a polyalkylphenoxyalkanol which is subsequently reacted with an appropriate amine to provide the desired polyalkylphenoxyaminoalkane. In another aspect, the terminal hydroxy group on the polyalkylphenoxyalkanol may first be converted to a suitable leaving group, such as a mesylate, chloride or bromide, and the like, by reaction with a suitable reagent, such as methanesulfonyl chloride. The resulting polyalkylphenoxyalkyl mesylate or equivalent intermediate may then be converted to a phthalimide derivative by reaction with potassium phthalimide in the presence of a suitable solvent, such as N,N-dimethylformamide. The polyalkylphenoxyalkyl phthalimide derivative is subsequently converted to the desired polyalkylphenoxyaminoalkane by reaction with a suitable amine, such as hydrazine. Alternatively, the leaving group can be converted to an azide, as described, for example, in Turnbull Scriven, Chemical Reviews, Volume 88, pages 297-368, 1988. The azide is subsequently converted to the desired polyalkylphenoxyaminoalkane by reduction with hydrogen and a catalyst, such as palladium on carbon or a Lindlar catalyst.

When the suitable leaving group is a halogen, the polyalkylphenoxyalkanol may be reacted with a suitable halogenating agent, such as HCl, thionyl chloride, or epichlorohydrin, followed by displacement of the chloride with a suitable amine, such as ammonia, a primary or secondary alkyl monoamine, or a polyamine, as described, for example, in U.S. Pat. No. 4,247,301 to Honnen, the disclosure of which is incorporated herein by reference.

Alternatively, the polyalkylphenoxyaminoalkanes may be prepared from the corresponding polyalkylphenoxyalkanol by a process commonly referred to as reductive amination, such as described in U.S. Pat. No. 5,112,364 to Rath et al. and U.S. Pat. No. 4,332,595 to Herbstman et al., the disclosures of which are incorporated herein by reference. In the reductive amination procedure, the polyalkylphenoxyalkanol is aminated with an appropriate amine, preferably ammonia, in the presence of hydrogen and a hydrogenation-dehydrogenation catalyst. The amination reaction is typically carried out at temperatures in the range of about 160° C. to about 250° C. and pressures of about 1,000 to about 5,000 psig, preferably about 1,500 to about 3,000 psig. Suitable hydrogenation-dehydrogenation catalysts include those containing platinum, palladium, cobalt, nickel, copper, or chromium, or mixtures thereof. Generally, an excess of the ammonia reactant is used, such as about a 5-fold to about 60-fold molar excess, and preferably about a 10-fold to about 40-fold molar excess.

In an another alternative procedure, the polyalkyl phenol can be reacted with an aziridine or a 2-alkyl or 2,3-dialkyl substituted aziridine where alkyl is 1 to 6 carbon atoms. The reaction of aziridines with alcohols to produce beta-amino ethers is well known in the art and is discussed, for example, in Ham and Dermer, "Ethyleneimine and Other Aziridines", Academic Press, New York, 1969, pages 224-227 and 256-257.

U.S. Pat. No. 6,486,352 describes a process of aminoethylation of polyalkylphenol in the presence of a basic catalyst with a β-amino alcohol with a dialkyl carbonate. Suitable β-amino alcohols are of the formula $NH_2$—$CHR^6CH_2$—OH wherein $R^6$ is a lower alkyl having 1 to 6 carbon atoms, phenyl, alkyaryl, or arylalkyl and the dialkyl carbonate is of the formula $(R^7O)_2CO$ where $R^7$ is lower alkyl having 1 to about 6 carbon atoms. In this regard the β-amino alcohol and the dialkyl carbonate may react to form carbamate intermediates and 2-oxazolidinones which further react. In another aspect α-aminoacids may be employed likewise from β-amino alcohols and/or insitu formation of the 2-oxaxolidinone. Numerous methods are known in the art for example, such reaction may involves a) reduction of the α-aminoacid carboxylic function, b) conversion of the free amino group into carbamate and c) base promoted cyclicization. Alternatively, the carboxylic group of the α-aminoacid may be esterified while protecting the amino group to give for example a N-benzyoxycarbamate intermediate which may be reduced lithium borohydride to form the oxazolidinone.

Japanese Patent Publication No. JP 2592732 B2 discloses a method of producing phenoxyethylamines by reacting, under base conditions, low molecular weight phenols and 2-oxazolidinone. German Patent Publication DE 19711004 A1 discloses the use of 2-oxazolidinone to prepare phenoxyaminoalkanes from low molecular weight phenols. 2-4-(Phenoxyphenoxy) ethylamine and ethyl 2-(Phenoxyphenoxy)ethylcarbamate are sequentially prepared in high yield and selectivity by the aminoethylation of 4-phenoxyphenol with 2-oxazolidinone under inert atmosphere, followed by amidation of 2-4-(Phenoxyphenoxy)ethylamine with carbonate derivatives.

U.S. Pat. Nos. 6,384,280 and 6,649,800 disclose a method for producing polyalkylphenoxyaminoalkanes by aminoethylation of a polyalkylphenol compound in the presence of a basic catalyst with a 2-oxazolidinone preferably in the presence of an alcohol, such as a lower alkyl alcohol.

Examples of suitable oxazolidinone compounds include, but are not limited to, 2-oxazolidinone, 4-methyl-2-oxazolidinone, 4-isopropyl-2-oxazolidinone, 4-phenyl-2-oxazolidinone, and 4-benzyl-2-oxazolidinone. The 2-oxazolidinone compound is preferred. These compounds are readily commercially available and may be purchased for example from Sigma-Aldrich Chemical Company. Alternatively, these compounds may be synthesized by conventional methods apparent to the skilled artisan.

The basic catalyst employed in the process of the present disclosure will generally be any of the well-known basic catalyst selected from the group of alkali metal lower alkoxides, alkali hydrides or alkali metal hydroxides. Typical alkali metal lower alkoxides include, but are not limited to, sodium methoxide, potassium methoxide, sodium ethoxide, potassium ethoxide, sodium propoxide, potassium propoxide, sodium isopropoxide, potassium isopropoxide, sodium butoxide, potassium butoxide. Typically, the alkali metal lower alkoxides will contain 1 to about 6, preferably 1 to about 4, carbon atoms. Preferably, the alkali metal lower alkoxide is sodium methoxide. Sodium hydride and potassium hydride are typical alkali hydrides. Examples of alkali metal hydroxides include, but are not limited to, sodium hydroxide, lithium hydroxide, or potassium hydroxide. Sodium hydroxide and potassium hydroxide are preferred.

Typically, the reaction temperature for the aminoethylation reaction will be in the range of about 100° C. to 250° C., and preferably in the range of about 130° C. to 210° C. The reaction pressure will generally be atmospheric or lower. Lower pressures may be used to facilitate the removal of carbon dioxide. Other carbon dioxide scavengers may be employed to facilitate the reaction, such as, for example, magnesium oxide or calcium oxide.

When lower alcohols are used, it is advantageous to carry out the reaction under pressure, for example up to 100 psig depending on the alcohol, in order to raise the boiling temperature of the reaction mixture to the optimal level for the reaction. In this case, some means must be provided to remove $CO_2$ so that carbonate salts are not formed in the reactor. This may be accomplished by controlled boiling of the reaction mixture so that solvent vapors carry the $CO_2$ overhead into a column that condenses and recycles the solvent while venting the $CO_2$. Nitrogen sparging into the reaction mixture or purging of the reactor head space may also be used to accomplish the same end while maintaining pressure on the reactor.

The molar ratio of 2-oxazolidinone or a derivative thereof to the aromatic alcohol (phenol) compound is normally in the range of about 5:1 to 0.9:1, and preferably will be in the range of about 2:1 to 1:1. In general, the number of equivalents of the basic catalyst per equivalents of phenol will be in the range of about 0.05:1 to 1:1, and preferably in the range of about 0.1:1 to 1:1.

The aminoethylation reaction may be carried out neat or in the presence of a solvent which is inert to the reaction of the phenol compound and the 2-oxazolidinone or a derivative thereof. An inert solvent is often used to facilitate handling and to promote good contacting of the reactants. When employed, examples of inert solvents include heptane, benzene, toluene, chlorobenzene and 250 thinner which is a mixture of aromatics, paraffin's and naphthenes. Kerosene-type jet fuel is another example of the latter mixture. Other examples of inert solvents that are aromatic mixtures include Exxon Aromatic 100, Exxon Aromatic 150, Solvesso 100, Total Solvarex 9 and the like. Other solvents apparent to those skilled in the art may also be used. For example, any number of ethers, aprotic polar solvents or alcohols may also be useful in the process of the present disclosure. Particularly suited alcohols are alkylalcohols. Examples of typical alcohols include n-propanol, n-butanol, 1-pentanol, 1-hexanol, 1-heptanol, and mixed isomers of each of the foregoing alcohols including branched- or straight-chain alcohols. 1-Hexanol or hexanol isomers are preferred. Examples of commercial alcohols available from ExxonMobil Chemical that are a mix of several isomers include Exxal 6 (hexyl alcohol) and Exxal 7 (isoheptyl alcohol). When employed, the molar ratio of the alcohol to the phenol compound is normally in the range of about 0.2:1 to 5:1, preferably about 0.4:1 to 2:1, and most preferably about 0.5:1 to 1.5:1.

The aminoethylation reaction will generally be carried out over a period of about 2 to 24 hours, and preferably over a period of about 3 to 20 hours. Upon completion of the reaction, the desired phenoxyaminoalkane is isolated using conventional techniques.

U.S. Pat. No. 5,276,192 discloses a two-step process of reacting a suitable phenol with 2-oxazoline to form a phenoxyethyl-acetamide intermediate which is thereafter hydrolyzed, preferably in an aqueous phosphoric acid. Similarly, WO 03/0954416 discloses a method a method to produce 2-alkoxyphenoxyethanamine via a two-step process by producing a 2-alkoxyphenolyethylacetamide using the reaction of an ortho substituted phenol with a 2-alkyloxazoline followed by hydrolyzation of the acetamide with water in the presence of organic or mineral acid such as hydrochloric acid or sulfuric acid preferred over phosphoric acid. There are numerous other ways to hydrolyze the amide to the amine known in the art, such as using base catalyzed conditions with KOH, NaOH, $Ba(OH)_2$ which in one aspect is preferred.

In another aspect, the aryloxy-alkyene amine is prepared by cyanoethylation of a hydroxy-aryl moiety followed by hydrogenation and such reactions are known in the art, U.S. Pat. Nos. 2,974,160; 2,421,837; U.S. Pat. App. 2003/0150154 and the like. Commonly an aromatic alcohol is reacted with acrylonitrile in the presence a well-known catalyst at a temperature in the range of about 20° C. to 100° C., and preferably from about 25° C. to 65° C. Typical catalysts include alkali metal hydroxides, alkoxides and hydrides, alkali metal salts, and tetrahydrocarbyl ammonium hydroxides and alkoxides. The amount of base employed will generally range from about 0.001 to 1.0 equivalent, preferably from about 0.01 to 0.1 equivalent. The acrylonitrile employed will generally range from about 1 to 20 equivalents, preferably from about 1 to 10 equivalents. The reaction may take place in the presence or absence of an inert solvent. The time of reaction will vary depending on the particular aromatic alcohol and acrylonitrile reactants, the catalyst used and the reaction temperature. For example 2-naphthol when heated with excess acrylonitrile in the presence of a catalytic amount of Triton B leads to the ether product of β-(2-naphthoxy)propionitrile whereas equimolar in sodium hydroxide yields the carbon-cyanoethylation product, 1-(β-cyanoethyl)-2-naphthol, see K. H. Takemura J. Am. Chem. Soc. 69, vol. 32, 2343 (1947).

The CN group from the cyanoethylation reaction may be reduced by any number of procedures well known in the art to an amino group —$CH_2NH_2$ group under catalytic hydrogenation conditions to yield the ArO—$CH_2CH(R^8)CH_2NH_2$ compound wherein $R^8$ selected from hydrogen or $C_{1-6}$ alkyl, preferably R' is hydrogen or methyl. Typically, this reaction is conducted using a nickel, Raney nickel, cobalt, Raney cobalt, copper-chromite, platinum, palladium, or rhodium catalyst. Preferably, the catalyst is nickel, Raney nickel, or platinum. The hydrogen pressure, time, and temperature depend on the catalyst employed. An inert solvent may be employed such as ethanol, ethyl acetate, and the like. Ammonium may also be added as a diluent. Hydrogenation of CN groups is further discussed, for example, in P. N. Rylander, Catalytic Hydrogenation in Organic Synthesis, Second Edition, pp. 138-152, Academic Press (1979) and H. F. Rase, Handbook of Commercial Catalysts, Heterogeneous Catalyst, pp. 138-148, CRC Press (2000) and references cited therein.

The reaction between the copolymer substrate intermediate having grafted thereon carboxylic acid acylating function and the prescribed aryloxyalkylene amine compound is preferably conducted by heating a solution of the copolymer substrate under inert conditions and then adding the amine compound to the heated solution generally with mixing to effect the reaction. It is convenient to employ an oil solution of the copolymer substrate heated to 120° C. to 175° C., while maintaining the solution under a nitrogen blanket. The amine compound is added to this solution and the reaction is effected under the noted conditions.

The aryloxyalkylene amine functionalized acylated copolymer substrate of the present disclosure can be incorporated into lubricating oil in any convenient way. Thus, the grafted, multi-functional copolymers reaction product can be added directly to the lubricating oil by dispersing or dissolving the same in the lubricating oil at the desired level of concentration. Such blending into the lubricating oil can occur at room temperature or elevated temperatures. Alternatively, the reaction product can be blended with a suitable oil-soluble solvent/diluent (such as benzene, xylene, toluene, lubricating base oils and petroleum distillates) to form a concentrate, and then blending the concentrate with a lubricating oil to obtain the final formulation. Such additive concentrates will typically contain (on an active ingredient (A.I.) basis) from about 3 to about 95 wt. %, and preferably from about 5 to about 35 wt. %, grafted, multi-functional aryloxyalkylene amine copolymer additive, and typically from about 20 to 90 wt %, preferably from about 40 to 60 wt %, preferably from about 10 to 13 wt % base oil based on the concentrate weight.

Lubricating oils containing the aryloxyalkylene amine functionalized acylated copolymer substrate of the present disclosure may be beneficially employed directly, or alternatively as pre-diluted in base oil in concentrate form as typically used for lubricating oil additives. Suitable base oil have been described herein.

Aryl Amine

Non-limiting examples of aromatic amines include the following:

(a) an N-arylphenylenediamine represented by the formula (1):

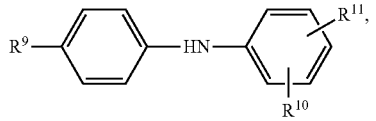

(1)

$R^9$ is H, —NHaryl, —NHalkaryl, or a branched or straight chain hydrocarbyl radical having from about 4 to about 24 carbon atoms selected from alkyl, alkenyl, alkoxyl, aralkyl or alkaryl; $R^{10}$ is —$NH_2$, —$(NH(CH_2)_n)_mNH_2$, —NHalkyl, —NHaralkyl, —$CH_2$-aryl-$NH_2$, in which n and m each independently have a value from about 1 to about 10; and $R^{11}$ is hydrogen, alkyl, alkenyl, alkoxyl, aralkyl, or alkaryl, having from about 4 to about 24 carbon atoms.

Particularly preferred N-arylphenylenediamines are N-phenylphenylenediamines (NPPDA), for example, N-phenyl-1,4-phenylenediamine, N-phenyl-1,3-phenylenediamine, and N-phenyl-1,2-phenylenediamine and N-naphthyl-1,4-phenylenediamine. Other derivatives of NPPDA may also be included, such as N-propyl-N'-phenylphenylenediamine.

(b) aminocarbazole represented by the formula (2):

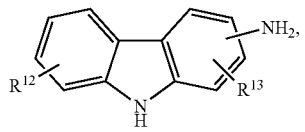

(2)

in which $R^{12}$ and $R^{13}$ each independently represent hydrogen or an alkyl or alkenyl radical having from about 1 to about 14 carbon atoms, (c) an amino-indazolinone represented by the formula (3):

(3)

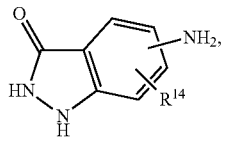

in which RH is hydrogen or an alkyl radical having from about 1 to about 14 carbon atoms.

(d) an aminomercaptotriazole represented by the formula (4):

(4)

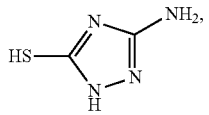

(e) an aminoperimidine represented by the formula (5):

(5)

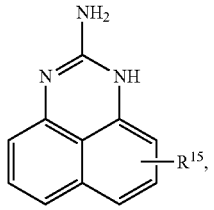

in which $R^{15}$ represents hydrogen or an alkyl radical having from about 1 to about 14 carbon atoms;

(f) an aryloxyphenyleneamine represented by the formula (6):

(6)

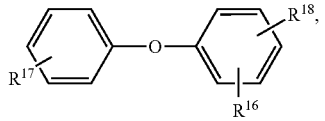

in which $R^{16}$ is H, —NHaryl, —NHalkaryl, or branched or straight chain radical having from about 4 to about 24 carbon atoms that can be alkyl, alkenyl, alkoxyl, aralkyl or alkaryl; $R^{17}$ is $—NH_2$, $—(NH(CH_2)_n)_m$ $NH_2$, —NHalkyl, or —NHaralkyl, in which n and m each independently have a value from about 1 to about 10; and $R^{18}$ is hydrogen, alkyl, alkenyl, alkoxyl, aralkyl, or alkaryl, having from about 4 to about 24 carbon atoms; A particularly preferred aryloxyphenyleneamine is 4-phenoxyaniline;

(g) an aromatic amine comprising two aromatic groups, linked by a group, L, represented by the following formula (7):

(7)

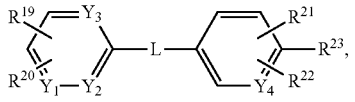

wherein L is selected from —O—, —N═N—, —NH—, $—CH_2NH$, $—C(O)NR^{24}—$, —C(O)O—, $—SO_2—$, $—SO_2NR^{25}—$ or $—SO_2NH—$, wherein $R^{24}$ and $R^{25}$ independently represent a hydrogen, an alkyl, an alkenyl or an alkoxy group having from about 1 to about 8 carbon atoms; wherein each $Y_1$, $Y_2$, $Y_3$ and $Y_4$ are independently N or CH provided that $Y_1$ and $Y_2$ may not both be N; $R^{19}$ and $R^{20}$ independently represent a hydrogen, alkyl, aryl, alkaryl, aralkyl, alkoxy, hydroxyalkyl, aminoalkyl, —OH, $—NO_2$, $—SO_3H$, $—SO_3Na$, $CO_2H$ or salt thereof, $—NR^{26}R^{27}$ wherein $R^{26}$ and $R^{27}$ are independently hydrogen, alkyl, aryl, arylalkyl, or alkaryl; $R^{21}$ and $R^{22}$ independently represent a hydrogen, an alkyl, an alkenyl or an alkoxy group having from about 1 to about 8 carbon atoms, —OH, $—SO_3H$ or $—SO_3Na$; $R^{23}$ represents $—H_2$, $—NHR^{28}$, wherein $R^{28}$ is an alkyl or an alkenyl group having from about 1 to about 8 carbon atoms, $—CH_2—(CH_2)_n—NH_2$ or $—CH_2$-aryl-$NH_2$ and n is from 0 to about 10;

(h) an aminothiazole selected from the group consisting of aminothiazole, aminobenzothiazole, aminobenzothiadiazole and aminoalkylthiazole;

(i) an aminoindole represented by the formula (8):

(8)

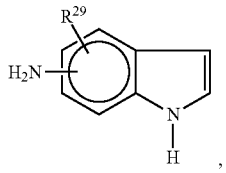

wherein $R^{29}$ represents a hydrogen, an alkyl or an alkenyl group having from about 1 to about 14 carbon atoms;

(j) an aminopyrrole represented by the formula (9):

(9)

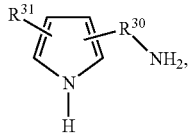

wherein $R^{30}$ represents a divalent alkylene group having about 2 to about 6 carbon atoms, and $R^{31}$ represents a hydrogen, an alkyl or an alkenyl group having from about 1 to about 14 carbon atoms;

(k) a ring substituted or unsubstituted aniline, such as nitroaniline or 4-aminoacetanilide;

(l) an aminoquinoline;

(m) an aminobenzimidazole;

(n) a N,N-dialkylphenylenediamine;

(o) a benzylic amine, such as benzylamine, naphthalen-2-ylmethanamine, 1,2,3,4-tetrahydronaphthalen-1-amine, pyridin-3-ylmethanamine, and the like;

(p) a napthylamine;

(q) an aminoanthracene.

Commercially available dispersants are suitable for use in the present disclosure. For example, HiTEC® 1910 dispersant, an ethylene-propylene dispersant, manufactured by Ethyl Corporation, Richmond, Va. is especially preferred for use in the present disclosure. HiTEC® 1910 dispersant is an ethylene-propylene copolymer grafted with maleic anhydride and reacted with n-phenyl phenylene diamine. A more complete list of nitrogen-containing compounds that can be reacted with the functionalized OCP are described in U.S. Pat. Nos. 7,485,603; 7,786,057; 7,253,231; 6,107,257; and 5,075,383 and are available commercially (e.g., HiTEC® 5777 available from Afton Corporation).

Low molecular weight ethylene-α-olefin succinic anhydride dispersants, as described in U.S. Pat. Nos. 5,075,383 and 6,117,825 is also suitable for use in the present disclosure. An example of a commercially available low molecular weight ethylene-propylene succinic anhydride dispersant (LEPSAD) is HiTEC® 1910 dispersant, available from Ethyl Corporation, Richmond, Va.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend. Thus, the grafted, multi-functional olefin aryloxyalkylene amine copolymer would usually be employed in the form of a 10 to 50 wt. % concentrate, for example, in a lubricating oil fraction. The following examples are presented to illustrate specific embodiments of this disclosure and are not to be construed in any way as limiting the scope of the disclosure. Unless indicated otherwise, all parts are parts by weight, temperatures are in degrees Celsius, and pressures in millimeters mercury (mmHg). Any filtrations are conducted using a diatomaceous earth filter aid. Analytical values are obtained by actual analysis.

Polymer Analyses

The ethylene contents as an ethylene weight percent ($C_2$ wt %) for the ethylene-based copolymers are typically determined according to ASTM D3900.

The number average molecular weight of the polymers were determined using Gel Permeation Chromatography (GPC) using trichlorobenzene (TCB) as solvent at 145° C. using a triple detection method with polystyrene calibrations.

Thickening efficiency (TE) is a measure of the thickening ability of the polymer in oil, and is defined as: $TE=2/c\times\ln((kv_{(polymer+oil)})/kv_{oil})/\ln(2)$, where c is the concentration of the polymer and kv is kinematic viscosity at 100° C. according to ASTM D445. The shear stability index (SSI) is an indication of the resistance of polymers to permanent mechanical shear degradation in an engine. The SSI can be determined by passing a polymer-oil solution for 30 cycles through a high shear Bosch diesel injector according to the procedures listed in ASTM D6278. The SSI of a polymer can be calculated from the viscosity of the oil without polymer and the initial and sheared viscosities of the polymer-oil solution using:

$$SSI=100\times(kv_{(polymer+oil),\,fresh}-kV_{(polymer+oil),\,sheared})/(kV_{(polymer+oil),fresh}-kV_{oil,fresh})$$

The amount of dispersant-type VI improver in the lubricating oil composition can vary. In one embodiment, the amount of dispersant-type VI improver in the lubricating oil composition is from about 0.10 to about 18, from about 0.10 to about 10, from about 0.10 to about 5, from about 0.10 to about 2.5, from about 0.10 to about 2.0, from about 0.10 to about 1.00 wt. % polymer based on the total weight of the lubricating oil composition. In one embodiment, the amount of dispersant-type VI improver in the lubricating oil composition is from about 0.10 to about 0.80 wt. % polymer, from about 0.20 to about 0.60 wt. % polymer, from about 0.20 to about 0.50 wt. %, or from about 0.2 to about 0.40 wt. % based on the total weight of the lubricating oil composition.

Secondary and/or Tertiary Hydrocarbyl Amine Compounds

In addition to providing increased cam wear benefits when used with the dispersant-type viscosity improver described above, the secondary and/or tertiary amine compounds are also useful for increasing the TBN of lubricating oil compositions without introducing sulfated ash.

Thus, in an aspect the secondary hydrocarbylamine is a compound having the following formula (10):

$$R^{32}R^{33}NH \quad (10),$$

wherein $R^{32}$ and $R^{33}$ are the same or different and each individually are selected from the group consisting of straight-chain or branched, saturated or unsaturated $C_1$-$C_{40}$ hydrocarbyl group.

In one embodiment, at least one of $R^{32}$ and $R^{33}$ is a $C_8$-$C_{40}$ hydrocarbyl group. In another embodiment, at least one of $R^{32}$ and $R^{33}$ is a $C_8$-$C_{20}$ hydrocarbyl group. In yet another embodiment, at least one of $R^{32}$ and $R^{33}$ is a $C_{12}$-$C_{20}$ hydrocarbyl group.

In one embodiment, at least one of $R^{32}$ and $R^{33}$ is a $C_8$-$C_{20}$ straight-chain hydrocarbyl group. In another embodiment, at least one of $R^{32}$ and $R^{33}$ is a $C_8$-$C_{20}$ straight-chain hydrocarbyl group. In yet another embodiment, at least one of $R^{32}$ and $R^{33}$ is a $C_{12}$-$C_{20}$ straight-chain hydrocarbyl group.

In one embodiment, at least one of $R^{32}$ and $R^{33}$ is a $C_8$-$C_{20}$ branched hydrocarbyl group. In another embodiment, at least one of $R^{32}$ and $R^{33}$ is a $C_8$-$C_{20}$ branched hydrocarbyl group. In yet another embodiment, at least one of $R^{32}$ and $R^{33}$ is a $C_{12}$-$C_{20}$ branched hydrocarbyl group.

In one embodiment, at least one of $R^{32}$ and $R^{33}$ is a saturated $C_8$-$C_{40}$ hydrocarbyl group. In another embodiment, at least one of $R^{32}$ and $R^{33}$ is a saturated $C_8$-$C_{20}$ hydrocarbyl group. In yet another embodiment, at least one of $R^{32}$ and $R^{33}$ is a saturated $C_{12}$-$C_{20}$ hydrocarbyl group.

In one embodiment, at least one of $R^{32}$ and $R^{33}$ is an unsaturated $C_8$-$C_{40}$ hydrocarbyl group. In another embodiment, at least one of $R^{32}$ and $R^{33}$ is an unsaturated $C_8$-$C_{20}$ hydrocarbyl group. In yet another embodiment, at least one of $R^{32}$ and $R^{33}$ is an unsaturated $C_{12}$-$C_{20}$ hydrocarbyl group.

In one embodiment, at least one of $R^{32}$ and $R^{33}$ is a saturated $C_8$-$C_{40}$ straight-chain hydrocarbyl group. In another embodiment, at least one of $R^{32}$ and $R^{33}$ is a saturated $C_8$-$C_{20}$ straight-chain hydrocarbyl group. In yet another embodiment, at least one of $R^{32}$ and $R^{33}$ is a saturated $C_{12}$-$C_{20}$ straight-chain hydrocarbyl group.

In one embodiment, at least one of $R^{32}$ and $R^{33}$ is an unsaturated $C_8$-$C_{40}$ straight-chain hydrocarbyl group. In another embodiment, at least one of $R^{32}$ and $R^{33}$ is an unsaturated $C_8$-$C_{20}$ straight-chain hydrocarbyl group. In yet another embodiment, at least one of $R^{32}$ and $R^{33}$ is an unsaturated $C_{12}$-$C_{20}$ straight-chain hydrocarbyl group.

In one embodiment, at least one of $R^{32}$ and $R^{33}$ is a saturated $C_8$-$C_{40}$ branched hydrocarbyl group. In another embodiment, at least one of $R^{32}$ and $R^{33}$ is a saturated $C_8$-$C_{20}$ branched hydrocarbyl group. In yet another embodiment, at least one of $R^{32}$ and $R^{33}$ is a saturated $C_{12}$-$C_{20}$ branched hydrocarbyl group.

In one embodiment, at least one of $R^{32}$ and $R^{33}$ is an unsaturated $C_8$-$C_{40}$ branched hydrocarbyl group. In another embodiment, at least one of $R^{32}$ and $R^{33}$ is an unsaturated $C_8$-$C_{20}$ branched hydrocarbyl group. In yet another embodiment, at least one of $R^{32}$ and $R^{33}$ is an unsaturated $C_{12}$-$C_{20}$ branched hydrocarbyl group.

In one embodiment, both $R^{32}$ and $R^{33}$ are a $C_8$-$C_{20}$ hydrocarbyl group. In another embodiment, both $R^{32}$ and $R^{33}$ are a $C_8$-$C_{20}$ hydrocarbyl group. In yet another embodiment, both $R^{32}$ and $R^{33}$ is a $C_{12}$-$C_{20}$ hydrocarbyl group.

In one embodiment, both $R^{32}$ and $R^{33}$ are a $C_8$-$C_{40}$ straight-chain hydrocarbyl group. In another embodiment, both $R^{32}$ and $R^{33}$ are a $C_8$-$C_{20}$ straight-chain hydrocarbyl group. In yet another embodiment, both $R^{32}$ and $R^{33}$ are a $C_{12}$-$C_{20}$ straight-chain hydrocarbyl group.

In one embodiment, both $R^{32}$ and $R^{33}$ are a $C_8$-$C_{40}$ branched hydrocarbyl group. In another embodiment, both $R^{32}$ and $R^{33}$ are a $C_8$-$C_{20}$ branched hydrocarbyl group. In yet another embodiment, both $R^{32}$ and $R^{33}$ are a $C_{12}$-$C_{20}$ branched hydrocarbyl group.

In one embodiment, both $R^{32}$ and $R^{33}$ are a saturated $C_8$-$C_{20}$ hydrocarbyl group. In another embodiment, both $R^{32}$ and $R^{33}$ are a saturated $C_8$-$C_{20}$ hydrocarbyl group. In yet another embodiment, both $R^{32}$ and $R^{33}$ are a saturated $C_{12}$-$C_{20}$ hydrocarbyl group.

In one embodiment, both $R^{32}$ and $R^{33}$ are an unsaturated $C_8$-$C_{20}$ hydrocarbyl group. In another embodiment, both $R^{32}$ and $R^{33}$ are an unsaturated $C_8$-$C_{20}$ hydrocarbyl group. In yet another embodiment, both $R^{32}$ and $R^{33}$ are an unsaturated $C_{12}$-$C_{20}$ hydrocarbyl group.

In one embodiment, both $R^{32}$ and $R^{33}$ are a saturated $C_8$-$C_{40}$ straight-chain hydrocarbyl group. In another embodiment, both $R^{32}$ and $R^{33}$ are a saturated $C_8$-$C_{20}$ straight-chain hydrocarbyl group. In yet another embodiment, both $R^{32}$ and $R^{33}$ are a saturated $C_{12}$-$C_{20}$ straight-chain hydrocarbyl group.

In one embodiment, both $R^{32}$ and $R^{33}$ are an unsaturated $C_8$-$C_{40}$ straight-chain hydrocarbyl group. In another embodiment, both $R^{32}$ and $R^{33}$ are an unsaturated $C_8$-$C_{20}$ straight-chain hydrocarbyl group. In yet another embodiment, both $R^{32}$ and $R^{33}$ are an unsaturated $C_{12}$-$C_{20}$ straight-chain hydrocarbyl group.

In one embodiment, both $R^{32}$ and $R^{33}$ are a saturated $C_8$-$C_{20}$ branched hydrocarbyl group. In another embodiment, both $R^{32}$ and $R^{33}$ are a saturated $C_8$-$C_{20}$ branched hydrocarbyl group. In yet another embodiment, both $R^{32}$ and $R^{33}$ are a saturated $C_{12}$-$C_{20}$ branched hydrocarbyl group. In one embodiment, both $R^{32}$ and $R^{33}$ are an unsaturated $C_8$-$C_{40}$ branched hydrocarbyl group. In another embodiment, both $R^{32}$ and $R^{33}$ are an unsaturated $C_8$-$C_{20}$ branched hydrocarbyl group. In yet another embodiment, both $R^{32}$ and $R^{33}$ are an unsaturated $C_{12}$-$C_{20}$ branched hydrocarbyl group.

In one embodiment, both $R^{32}$ and $R^{33}$ are is a $C_1$-$C_6$ hydrocarbyl group. Non-limiting examples include methyl, ethyl, propyl, isopropyl, butyl, sec-butyl. tert-butyl, isobutyl, pentyl, hexyl group.

In one embodiment, at least one of $R^{32}$ and $R^{33}$ are derived from a fatty acid source. In another embodiment, both $R^{32}$ and $R^{33}$ are derived from a fatty acid source. The fatty acid source can be for example, but not limited to, tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil or mixtures thereof.

Non-limiting examples of secondary amines are: bis (2-ethylhexyl)amine, ditridecylamine, Di-octadecylamine (Armeen 218), Di-cocoalkylamines (Armeen 2C), Dihydrogenated Talloalkylamines (Armeen 2HT), 2-ethylhexyl, hydrogenated tallow amine (Armeen HTL8).

In one embodiment, the secondary amine is an alkoxylated amine. For example, the amine can be ethoxylated or propoxylated. Some nonlimiting examples of alkoxylated amines include: $CH_3(—O—C_2H_4)_xNH$, $C_2H_5(—O—C_2H_4)_x$ NH, $CH_3(—O—C_3H_6)_xNH$, $C_2H_5(—O—C_3H_6)_x$, n-$C_4H_9(—O—C_4H_8)_xNH$, $H(O—C_3H_6)_xNH$ and $H(O—C_4H_8)_xNH$, where x is from 2 to 50.

Thus, in an aspect the tertiary hydrocarbylamine is a compound having the following formula (11):

$$R^{34}R^{35}R^{36}N \quad (11),$$

wherein $R^{34}$, $R^{35}$, and $R^{36}$ are the same or different and each individually are selected from the group consisting of straight-chain or branched, saturated or unsaturated $C_1$-$C_{40}$ hydrocarbyl group.

In one embodiment, at least one of $R^{34}$, $R^{35}$, and $R^{36}$ is a $C_8$-$C_{40}$ hydrocarbyl group. In another embodiment, at least one of $R^{34}$, $R^{35}$, and $R^{36}$ is a $C_8$-$C_{20}$ hydrocarbyl group. In yet another embodiment, at least one of $R^{34}$, $R^{35}$, and $R^{36}$ is a $C_{12}$-$C_{20}$ hydrocarbyl group.

In one embodiment, at least one of $R^{34}$, $R^{35}$, and $R^{36}$ is a $C_8$-$C_{40}$ straight-chain hydrocarbyl group. In another embodiment, at least one of $R^{34}$, $R^{35}$, and $R^{36}$ is a $C_8$-$C_{20}$ straight-chain hydrocarbyl group. In yet another embodiment, at least one of $R^{34}$, $R^{35}$, and $R^{36}$ is a $C_{12}$-$C_{20}$ straight-chain hydrocarbyl group.

In one embodiment, at least one of $R^{34}$, $R^{35}$, and $R^{36}$ is a $C_8$-$C_{40}$ branched hydrocarbyl group. In another embodiment, at least one of $R^{34}$, $R^{35}$, and $R^{36}$ is a $C_8$-$C_{20}$ branched hydrocarbyl group. In yet another embodiment, at least one of $R^{34}$, $R^{35}$, and $R^{36}$ is a $C_{12}$-$C_{20}$ branched hydrocarbyl group.

In one embodiment, at least one of $R^{34}$, $R^{35}$, and $R^{36}$ is a saturated $C_8$-$C_{40}$ hydrocarbyl group. In another embodiment, at least one of $R^{34}$, $R^{35}$, and $R^{36}$ is a saturated $C_8$-$C_{20}$ hydrocarbyl group. In yet another embodiment, at least one of $R^{34}$, $R^{35}$, and $R^{36}$ is a saturated $C_{12}$-$C_{20}$ hydrocarbyl group.

In one embodiment, at least one of $R^{34}$, $R^{35}$, and $R^{36}$ is an unsaturated $C_8$-$C_{40}$ hydrocarbyl group. In another embodiment, at least one of $R^{34}$, $R^{35}$, and $R^{36}$ is an unsaturated $C_8$-$C_{20}$ hydrocarbyl group. In yet another embodiment, at least one of $R^{34}$, $R^{35}$, and $R^{36}$ is an unsaturated $C_{12}$-$C_{20}$ hydrocarbyl group.

In one embodiment, at least one of $R^{34}$, $R^{35}$, and $R^{36}$ is a saturated $C_8$-$C_{40}$ straight-chain hydrocarbyl group. In another embodiment, at least one of $R^{34}$, $R^{35}$, and $R^{36}$ is a saturated $C_8$-$C_{20}$ straight-chain hydrocarbyl group. In yet another embodiment, at least one of $R^{34}$, $R^{35}$, and $R^{36}$ is a saturated $C_{12}$-$C_{20}$ straight-chain hydrocarbyl group.

In one embodiment, at least one of $R^{34}$, $R^{35}$, and $R^{36}$ is an unsaturated $C_8$-$C_{40}$ straight-chain hydrocarbyl group. In another embodiment, at least one of $R^{34}$, $R^{35}$, and $R^{36}$ is an unsaturated $C_8$-$C_{20}$ straight-chain hydrocarbyl group. In yet another embodiment, at least one of $R^{34}$, $R^{35}$, and $R^{36}$ is an unsaturated $C_{12}$-$C_{20}$ straight-chain hydrocarbyl group.

In one embodiment, at least one of $R^{34}$, $R^{35}$, and $R^{36}$ is a saturated $C_8$-$C_{40}$ branched hydrocarbyl group. In another embodiment, at least one of $R^{34}$, $R^{35}$, and $R^{36}$ is a saturated $C_8$-$C_{20}$ branched hydrocarbyl group. In yet another embodiment, at least one of $R^{34}$, $R^{35}$, and $R^{36}$ is a saturated $C_{12}$-$C_{20}$ branched hydrocarbyl group.

In one embodiment, at least one of $R^{34}$, $R^{35}$, and $R^{36}$ is an unsaturated $C_8$-$C_{40}$ branched hydrocarbyl group. In another embodiment, at least one of $R^{34}$, $R^{35}$, and $R^{36}$ is an unsaturated $C_8$-$C_{20}$ branched hydrocarbyl group. In yet another embodiment, at least one of $R^{34}$, $R^{35}$, and $R^{36}$ is an unsaturated $C_{12}$-$C_{20}$ branched hydrocarbyl group. In one embodiment, at least two of $R^{34}$, $R^{35}$, and $R^{36}$ is a $C_8$-$C_{20}$ hydrocarbyl group. In another embodiment, at least two of $R^{34}$, $R^{35}$, and $R^{36}$ is a $C_8$-$C_{20}$ hydrocarbyl group. In yet another embodiment, at least two of $R^{34}$, $R^{35}$, and $R^{36}$ is a $C_{12}$-$C_{20}$ hydrocarbyl group.

In one embodiment, at least two of $R^{34}$, $R^{35}$, and $R^{36}$ is a $C_8$-$C_{20}$ straight-chain hydrocarbyl group. In another embodiment, at least two of $R^{34}$, $R^{35}$, and $R^{36}$ is a $C_8$-$C_{20}$ straight-chain hydrocarbyl group. In yet another embodiment, at least two of $R^{34}$, $R^{35}$, and $R^{36}$ is a $C_{12}$-$C_{20}$ straight-chain hydrocarbyl group.

In one embodiment, at least two of $R^{34}$, $R^{35}$, and $R^{36}$ is a $C_8$-$C_{20}$ branched hydrocarbyl group. In another embodiment, at least two of $R^{34}$, $R^{35}$, and $R^{36}$ is a $C_8$-$C_{20}$ branched hydrocarbyl group. In yet another embodiment, at least two of $R^{34}$, $R^{35}$, and $R^{36}$ is a $C_{12}$-$C_{20}$ branched hydrocarbyl group.

In one embodiment, at least two of $R^{34}$, $R^{35}$, and $R^{36}$ is a saturated $C_8$-$C_{40}$ hydrocarbyl group. In another embodiment, at least two of $R^{34}$, $R^{35}$, and $R^{36}$ is a saturated $C_8$-$C_{20}$ hydrocarbyl group. In yet another embodiment, at least two of $R^{34}$, $R^{35}$, and $R^{36}$ is a saturated $C_{12}$-$C_{20}$ hydrocarbyl group. In one embodiment, at least two of $R^{34}$, $R^{35}$, and $R^{36}$ is an unsaturated $C_8$-$C_{40}$ hydrocarbyl group. In another embodiment, at least two of $R^{34}$, $R^{35}$, and $R^{36}$ is an unsaturated $C_8$-$C_{20}$ hydrocarbyl group. In yet another embodiment, at least two of $R^{34}$, $R^{35}$, and $R^{36}$ is an unsaturated $C_{12}$-$C_{20}$ hydrocarbyl group.

In one embodiment, at least two of $R^{34}$, $R^{35}$, and $R^{36}$ is a saturated $C_8$-$C_{40}$ straight-chain hydrocarbyl group. In another embodiment, at least two of $R^{34}$, $R^{35}$, and $R^{36}$ is a saturated $C_8$-$C_{20}$ straight-chain hydrocarbyl group. In yet another embodiment, at least two of $R^{34}$, $R^{35}$, and $R^{36}$ is a saturated $C_{12}$-$C_{20}$ straight-chain hydrocarbyl group.

In one embodiment, at least two of $R^{34}$, $R^{35}$, and $R^{36}$ is an unsaturated $C_8$-$C_{40}$ straight-chain hydrocarbyl group. In another embodiment, at least two of $R^{34}$, $R^{35}$, and $R^{36}$ is an unsaturated $C_8$-$C_{20}$ straight-chain hydrocarbyl group. In yet another embodiment, at least two of $R^{34}$, $R^{35}$, and $R^{36}$ is an unsaturated $C_{12}$-$C_{20}$ straight-chain hydrocarbyl group.

In one embodiment, at least two of $R^{34}$, $R^{35}$, and $R^{36}$ is a saturated $C_8$-$C_{40}$ branched hydrocarbyl group. In another embodiment, at least two of $R^{34}$, $R^{35}$, and $R^{36}$ is a saturated $C_8$-$C_{20}$ branched hydrocarbyl group. In yet another embodiment, at least two of $R^{34}$, $R^{35}$, and $R^{36}$ is a saturated $C_{12}$-$C_{20}$ branched hydrocarbyl group.

In one embodiment, at least two of $R^{34}$, $R^{35}$, and $R^{36}$ is an unsaturated $C_8$-$C_{40}$ branched hydrocarbyl group. In another embodiment, at least two of $R^{34}$, $R^{35}$, and $R^{36}$ is an unsaturated $C_8$-$C_{20}$ branched hydrocarbyl group. In yet another embodiment, at least two of $R^{34}$, $R^{35}$, and $R^{36}$ is an unsaturated $C_{12}$-$C_{20}$ branched hydrocarbyl group.

In one embodiment, at least one of $R^{34}$, $R^{35}$, and $R^{36}$ is a $C_1$-$C_6$ hydrocarbyl group. Non-limiting examples include methyl, ethyl, propyl, isopropyl, butyl, sec-butyl. tert-butyl, isobutyl, pentyl, hexyl group.

In one embodiment, at least one of $R^{34}$, $R^{35}$, and $R^{36}$ is derived from a fatty acid source. In another embodiment, at least two of $R^{34}$, $R^{35}$, and $R^{36}$ is derived from a fatty acid source. The fatty acid source can be for example, but not limited to, tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil or mixtures thereof.

In one embodiment, the tertiary amine can be sterically hindered. The sterically hindered amine compound of general formula (11) is acyclic. The term "acyclic" is intended to mean that the sterically hindered amine compound of general formula (11) is free from any cyclic structures and aromatic structures. The sterically hindered amine compound of general formula (VII) can be exemplified by: N-tert-butyl-2-ethyl-N-methyl-hexan-1-amine, tert-amyl-tert-butylamine, N-tert-butylheptan-2-amine.

In one embodiment, the secondary and/or tertiary amine has 1 nitrogen atom. In one embodiment, the secondary and/or tertiary amine has 2 nitrogen atoms. In one embodiment, the secondary and/or tertiary amine has 3 nitrogen atoms. In one embodiment, the secondary and/or tertiary amine has 4 nitrogen atoms.

Alternatively, the secondary and/or tertiary amine compound may be a monomeric cyclic amine compound.

In one embodiment, the monomeric cyclic amine compound has the following formula (12):

(12)

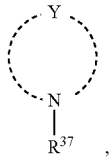

, where Y represents the type and number of atoms necessary to complete the cyclic ring. The ring designated by Y may include from 2 to 20, 3 to 15, 5 to 15, or 5 to 10, carbon atoms. The ring designated by Y may he a substituted or unsubstituted, branched or unhranched, divalent hydrocarbon group that includes at least one hetero atom, such as oxygen, or sulfur, and may include at least one heterogroup. In addition to including heteroatoms and/or heterogroups, the ring designated by Y may include at least one hydrocarhyl substituent group. In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y.

In formula (12), $R^{37}$ is a hydrogen atom or a hydrocarhyl group. For example, $R^{37}$ may be an alcohol group, an amino group, an alkyl group, an amide group, an ether group, or an ester group. $R^{37}$ may have 1 to 50, 1 to 25, 1 to 17, to 15, 1 to 12, 1, to 8, 1 to 6, or 1 to 4, carbon atoms. $R^{37}$ may be straight or branched. For example, each $R^{37}$ may be an alcohol group, amino group, alkyl group, amide group, ether group, or ester group having 1 to 50 carbon atoms, with the designated functional group (alcohol, etc.), heteroatom, or heterogroup bonded at various positions on the carbon atoms in the backbone.

In one embodiment, the monomeric cyclic amine compound may be exemplified by general formula (13):

(13)

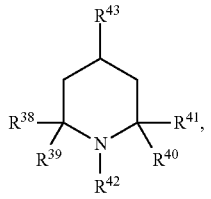

In general formula (13), $R^{38}$, $R^{39}$, $R^{40}$, $R^{41}$, $R^{42}$, and $R^{43}$ are each independently a hydrogen atom or a hydrocarbyl group having from 1 to 25 carbon atoms. For example, $R^{38}$, $R_{39}$, $R^{40}$, $R^{41}$, $R^{42}$, and $R^{43}$ may independently be substituted with an alcohol group, an amino group, an amide group, an ether group, or an ester group. $R^{38}$, $R^{39}$, $R^{40}$, $R^{41}$, $R^{42}$, and $R^{43}$ may independently have from 1 to 20, 1 to 15, 1 to 12, 1 to 8, 1 to 6, or 1 to 4, carbon atoms. In certain embodiments, at least one group designated by $R^{38}$, $R^{39}$, $R^{40}$, $R^{41}$, $R^{42}$, and $R^{43}$ is unsubstituted. Alternatively, at least two, three, four, five, or six groups designated by $R^{38}$, $R^{39}$, $R^{40}$, $R^{41}$, $R^{42}$, and $R^{43}$ are unsubstituted. Alternatively, still, it is contemplated that one, two, three, four, five, or six groups designated by $R^{38}$, $R^{39}$, $R^{40}$, $R^{41}$, $R^{42}$, and $R^{43}$ are substituted. For example, $R^{38}$, $R^{39}$, $R^{40}$, $R^{41}$, $R^{42}$, and $R^{43}$ may be an alcohol group, amino group, alkyl group, amide group, ether group, or ester group having 1 to 25 carbon atoms, with the designated functional group (alcohol, etc) bonded at various positions on the carbon chain.

In some embodiments, the amine compound, such as the monomeric acyclic amine compound or the monomeric cyclic amine compound, may be a sterically hindered amine compound. The sterically hindered amine compound may have a weight average molecular weight of from 100 to 1200. Alternatively, the sterically hindered amine compound may have a weight average molecular weight of from 200 to 800, or 200 to 600. Alternatively, still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. in other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

In one embodiment, the secondary amine is a hindered secondary amine compound.

In one embodiment, the tertiary amine compound is a hindered tertiary amine compound.

The sterically hindered amine compound may have general formula (14) or (15):

(14)

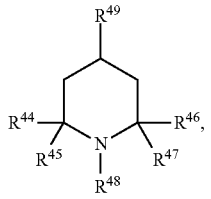

In general formula (14), $R^{45}$, $R^{46}$, $R^{47}$, and $R^{48}$ are each independently a hydrogen atom or a hydrocarbyl group having from 1 to 25 carbon atoms, wherein at least two of $R^{44}$, $R^{45}$, $R^{46}$, $R^{47}$, and $R^{48}$ are an alkyl group in one molecule; and $R^{49}$ is independently a hydrogen atom or a hydrocarbyl group having from 1 to 25 carbon atoms.

Each $R^{44}$, $R^{45}$, $R^{46}$, and $R^{47}$, may independently substituted with an alcohol group, an amide group, an ether group, or an ester group, and each $R^{44}$, $R^{45}$, $R^{46}$, $R^{47}$, $R^{48}$, and $R^{49}$ may independently have from 1 to 25, 1 to 20, 1 to 15, 1 to 12, 1 to 8, 1 to 6, or 1 to 4, carbon atoms.

In certain embodiments, at least one group designated by $R^{44}$, $R^{45}$, $R^{46}$, $R^{47}$, $R^{48}$, and $R^{49}$ is unsubstituted. Alternatively, at least two, three, four, five, or six groups designated by $R^{44}$, $R^{45}$, $R^{46}$, $R^{47}$, $R^{48}$, and $R^{49}$ are unsubstituted. In other embodiments, every group designated by $R^{44}$, $R^{45}$, $R^{46}$, $R^{47}$, $R^{48}$, and $R^{49}$ is unsubstituted. Alternatively, still, it is contemplated that one, two, three, four, five, or six groups designated by $R^{44}$, $R^{45}$, $R^{46}$, $R^{47}$, $R^{48}$, and $R^{49}$ are substituted.

Exemplary $R^{44}$, $R^{45}$, $R^{46}$, $R^{47}$, $R^{48}$, and $R^{49}$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (14), at least two, at least three, or all four groups, designated by $R^{44}$, $R^{45}$, $R^{46}$, $R^{47}$, and $R^{48}$ are each independently an alkyl group.

The sterically hindered amine compound of general formula (14) may be exemplified by the following compounds: 2,2,6,6-tetramethyl-4-octylpiperdine, 2,2,6,6-tetramethyl-4-decylpiperdine 2,2,6,6-tetramethyl-4-butylpiperdine, 2,2,6,6-tetramethyl-4-hexadecylpiperdine.

The sterically hindered amine compound may alternatively be exemplified by the general formula (15):

(15)

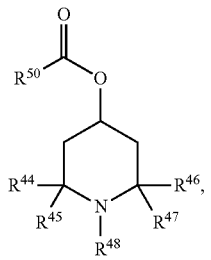

where $R^{44}$, $R^{45}$, $R^{46}$, $R^{47}$, and $R^{48}$ are as described above, wherein at least three of $R^{44}$, $R^{45}$, $R^{46}$, $R^{47}$, and $R^{48}$ are each independently an hydrocarbyl group. $R^{50}$ is a hydrocarbyl group having from 1 to 25 carbon atoms. It can be straight-chain or branched, saturated or unsaturated hydrocarbyl group. The sterically hindered amine compound of general formula (15) may be exemplified by the following compounds: (1,2,2,6,6-pentamethyl-4-piperdyl)octanoate, (1,2,2,6,6-pentamethyl-4-piperdyl)decanoate, 1,2,2,6,6-pentamethyl-4-piperdyl)dodecanoate, (2,2,6,6-tetramethyl-4-piperdyl)decanoate, or C12-21 and C18 unsaturated fatty acids 2,2,6,6-tetramethyl-4-piperidinyl esters (SABO® STAB UV 91, CAS# 167078-06-0).

The sterically hindered amine compound may alternatively be exemplified by the general formula (16):

(16)

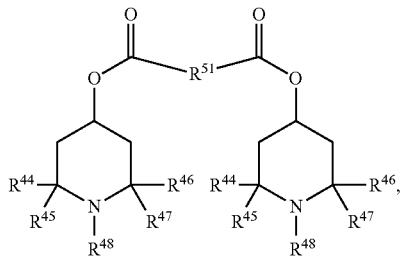

where $R^{44}$, $R^{45}$, $R^{46}$, $R^{47}$, and $R^{48}$ are as described above, wherein at least three of $R^{47}$, and $R^{48}$ are each independently an hydrocarbyl group. $R^{51}$ is a $C_1$-$C_{25}$ hydrocarbyl group. Nonlimiting examples of structures according to formula (16) include: Bis(1,2,2,6,6-pentamethyl-4-piperdinyl)sebacate (SABO® STAB UV 65) and Bis(2,2,6,6-tetramethyl-4-piperdinyl)sebacate (SABO® STAB UV 65), both available from Sabo and Vanderbilt Chemicals, LLC.

The sterically hindered amine compound may include a single ester group. However, the sterically hindered amine compound may alternatively be free from ester groups. In certain embodiments, the sterically hindered amine compound may include at least one, or only one, piperidine ring.

In one embodiment, the tertiary amine is an alkyl di-alkanolamine. Such alkyl di-alkanolamines include, but are not limited to, di-ethanolamines derived from coconut oil. Typically, the alkyl group in coconut oil comprises mixtures of caprylyl, capryl, lauryl, myristyl, palmityl stearyl, oleyl and linoleyl.

In one embodiment, the tertiary amine is an alkyl di-alkanolamine having the following formula (17):

(17)

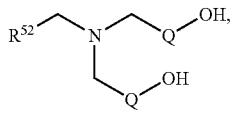

where $R^{52}$ has from 1 to 30 carbon atoms; preferably wherein $R^{52}$ has from 6 to 22 carbon atoms; more preferably, where $R^{52}$ has from about 8 to about 18 carbon atoms and where Q is a $C_1$ to $C_4$ linear or branched alkylene group. In one embodiment, $R^{52}$ has 17 carbon atoms. In another embodiment, $R^{52}$ has 11 carbon atoms.

In one embodiment, the di-alkanolamine comprises a bis-ethoxy alkylamine. For example, the bis-ethoxy alkylamine has the following formula (18):

(18)

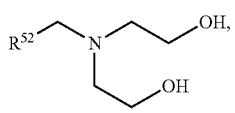

where $R^{52}$ comprises 1 to 30 carbon atoms; preferably where $R^{52}$ comprises 6 to 22 carbon atoms; more preferably, where $R^{52}$ comprises from about 8 to about 18 carbon atoms. In one embodiment, $R^{52}$ has 17 carbon atoms. In another embodiment, $R^{52}$ has 11 carbon atoms.

The alkyl group of the di-alkanolamides and di-alkanolamines can have varying levels of unsaturation. For example, the alkyl group can comprise double and triple bonds.

Typically, alkyl di-alkanolamines are commercially available from Akzo Nobel. For example, products sold under the tradename Ethomeen® C/12, Propomeen® T12, or Ethomeen® O/12 are suitable di-alkanolamines for use in the present disclosure.

Examples of alkyl alkanolamines include but are not limited to the following: Oleyl diethanolamine, dodecyl diethanolamine, 2-ethylhexyl diethanolamine, diethanolamine derived from coconut oil and diethanolamine derived from beef tallow and the like.

The tertiary amine may be prepared by methods that are well known in the art. Alkyl di-alkanolamines may be prepared according to U.S. Pat. Nos. 4,085,126; 7,479,473 and other methods that are well known in the art; or, they may be purchased from Akzo Nobel.

Other suitable amines suitable for use in the present disclosure are described in U.S. Pat. No. 9,145,530, US 20130252865, US 20140051621, US 20140106996 the disclosures of which is incorporated herein by reference.

In some embodiments, the secondary and/or tertiary amine does not contain an aromatic group. In some embodiments, the secondary and/or tertiary amine has one aromatic group and the other substituents (i.e., 1 or 2 depending on amine) are branched alkyl groups.

The secondary and/or tertiary amine compounds may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

Non-limiting examples of tertiary amines are: N,N-dimethyl-N-(2-ethylhexyl)amine, N,N-dimethyl-N-(2-propylheptyl)amine, dodecyldimethylamine (Armeen®DM12D), octadecyldimethylamine (Armeen®DM18D), hexadecyldimethylamine, oleyldimethylamine(Armeen®DMOD), cocoyldimethylamine (Armeen®DMCD), hydrogenated talloalkyldimethylamines (Armeen®DMHTD), dicocoylmethylamine (Armeen®M2C), tallowdimethylamine, ditallowmethylamine (Armeen®M2HT), tridodecylamine, trihexadecylamine (ARMEEN®316), trioctadecylamine, soyadimethylamine (Armeen®DMSD), tris(2-ethylhexyl) amine, 2-Ethylhexyl(tallow)methylamine (Armeen®MHTL8), dodecyldimetylamine (Armeen®DM12D), octadecyldimethylamine (Armeen®DM18D), Cocoalkyldimetylamine (Armeen®DMCD), Hydrogenated Tallowalkyldimethylamines (Armeen®DMHTD), Oleylalkyldimethylamine (Armeen®DMOD), Soyaalkyldimethylamines (Armeen®DMSD), and Alamine 336 (tri-n-octylamine).

In certain embodiments, the secondary and/or tertiary hydrocarbylamine compound has a TBN value of at least 20 mg KOH/g when tested according to ASTM D2896, a TBN value of at least 30 mg KOH/g when tested according to ASTM D2896, a TBN value of at least 40 mg KOH/g when tested according to ASTM D2896, a TBN value of at least 60 mg KOH/g when tested according to ASTM D2896, a TBN value of at least 80 mg KOH/g when tested according to ASTM D2896. Alternatively, the amine compound has a TBN value of at least 90, at least 100, at least 110, at least 120, at least 130, at least 140, at least 150, or at least 160, mg KOH/g, when tested according to ASTM D2896. Alternatively still, the amine compound may have a TBN value of from 20 to 500, 60 to 300, 80 to 200, 90 to 190, 100 to 180, or 100 to 150, mg KOH g, when tested according to ASTM D2896.

In some embodiments, the secondary and/or tertiary hydrocarbylamine compound does not negatively affect the total base number of the lubricant composition. Alternatively, the secondary and/or tertiary hydrocarbylamine compound may improve the TBN of the lubricant composition by, at least 0.5, at least 0.6, at least 0.7, at least 0.8, at least 0.9, at least 1.0, at least 1.5, at least 2, at least 2.5, at least 3, at least 3.5, at least 4, at least 4.5, at least 5, at least 10, or at least 15, mg KOH/g of the secondary and/or tertiary hydrocarbylamine compound. The TBN value of the lubricant composition can be determined according to ASTM D2896.

If the secondary and/or tertiary hydrocarbylamine compound is included in the additive package, the additive package includes the amine compound in an amount of from 0.1 to 50 wt. %, based on the total weight of the additive package. Alternatively, the additive package may include the secondary and/or tertiary hydrocarbylamine compound in an amount of from 1 to 25, 0.1 to 15, 1 to 10, 0.1 to 8, or 1 to 5, wt. %, based on the total weight of the additive package.

The lubricating oil composition includes the secondary and/or tertiary hydrocarbylamine compound in an amount of from 0.1 to 25, 0.1 to 20, 0.1 to 15, or 0.1 to 10, wt. %, based on the total weight of the lubricant composition. Alternatively, the lubricant composition may include the secondary and/or tertiary hydrocarbylamine compound in an amount of from 0.5 to 5, 1 to 3, or 1 to 2, wt. %, based on the total weight of the lubricant composition. In another embodiment, the lubricating oil composition may include the secondary and/or tertiary hydrocarbylamine compound in an amount of from greater than 0.1, greater than 0.2, greater than 0.25, greater than 0.3, greater than 0.35. greater than 0.4, greater than 0.45, greater than 0.5 wt. %, based on the total weight of the lubricating oil composition. Combinations of various secondary and/or tertiary hydrocarbylamine compounds are also contemplated.

In an aspect, the present disclosure provides a method for reducing wear in an internal combustion engine operated with a lubricating oil as described herein. In an embodiment, the engine wear is cam wear. In an embodiment, the method for reducing cam wear is measured according to the Cummins® ISB engine test (ASTM D7484-11).

Thus, in another aspect, the present disclosure provides use of a lubricating oil composition as described herein for reducing wear in an internal combustion engine. In an embodiment, the engine wear is cam wear. In an embodiment, the method for reducing cam wear is measured according to the Cummins® ISB engine test (ASTM D7484-11).

The Oil of Lubricating Viscosity

The neutral oil may be selected from Group I base stock, Group II base stock, Group III base stock, Group IV or poly-alpha-olefins (PAO), Group V, or base oil blends thereof. The base stock or base stock blend preferably has a saturate content of at least 65%, more preferably at least 75%; a sulfur content of less than 1%, preferably less than 0.6%, by weight; and a viscosity index of at least 85, preferably at least 100. These base stocks can be defined as follows:

Group I: base stocks containing less than 90% saturates and/or greater than 0.03% sulfur and having a viscosity index greater than or equal to 80 and less than 120 using test methods specified in Table 1 of the American Petroleum Institute (API) publication "Engine Oil Licensing and Certification Sheet" Industry Services Department, 14th Ed., December 1996, Addendum I, December 1998;

Group II: base stocks containing greater than or equal to 90% saturates and/or greater than 0.03% sulfur and having a viscosity index greater than or equal to 80 and less than 120 using test methods specified in Table 1 referenced above;

Group III: base stocks which are less than or equal to 0.03% sulfur, greater than or equal to 90% saturates, and greater than or equal to 120 using test methods specified in Table 1 referenced above.

Group IV: base stocks which comprise PAO's.

Group V: base stocks include all other base stocks not included in Group I, II, III, or IV.

For these definitions, saturates level can be determined by ASTM D 2007, the viscosity index can be determined by ASTM D 2270; and sulfur content by any one of ASTM D 2622, ASTM D 4294, ASTM D 4927, or ASTM D 3120.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 9W-30, 0W-40, 0W-50, 0W-60, 5W, 5W-20, 5W-30, 5W-40, 5W-50, 5W-60, 10W, 10W-20, 10W-30, 10W-40, 10W-50, 10W-60, 15W, 15W-20, 15W-30, 15W-40, 15W-50 or 15W-60. Oils used as gear oils can have viscosities ranging from about 2 cSt to about 2000 cSt at 100° C.

In one embodiment, the viscosity of the lubricating oils of the present disclosure are: 5W, 10W, and 15W formulations. In certain embodiments, the viscosity of the lubricating oils of the present disclosure are: 5W-20, 5W-30, 5W-40, 5W-50, 5W-60, 10W-20, 10W-30, 10W-40, 10W-50, 10W-60, 15W-20, 15W-30, 15W-40, 15W-50 and 15W-60 formulations.

Additional Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with additional antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

Example 1

2.6 wt. % of the additive (concentrate) of a functionalized polymer similar to that described in Example 27 of U.S. Pat. No. 9,115,237 and 0.40 wt. % of Armeen® M2HT (N-methyl-N,N-ditallowamine, Akzo Nobel, CAS 61788-63-4, total amine value 103-110 mg KOH/g) was tested in a fully formulated 5W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

Example 2

2.0 wt. % of the additive (concentrate) of a functionalized polymer similar to that described in Example 27 of U.S. Pat. No. 9,115,237 and 0.85 wt. % of Armeen® M2HT was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, a pour point depressant, and an olefin copolymer viscosity index improver.

Example 3

3.0 wt. % of the additive (concentrate) of a functionalized polymer similar to that described in Example 27 of U.S. Pat. No. 9,115,237 and 0.85 wt. % of Armeen® M2HT was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, a pour point depressant, and an olefin copolymer viscosity index improver.

Example 4

2.0 wt. % of the additive (concentrate) of a functionalized polymer similar to that described in Example 27 of U.S. Pat. No. 9,115,237 and 1.20 wt. % of Armeen® M2HT was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, a pour point depressant, and an olefin copolymer viscosity index improver.

Example 5

2.0 wt. % of the additive (concentrate) of a functionalized polymer similar to that described in Example 27 of U.S. Pat. No. 9,115,237 and 0.80 wt. % of SABO® STAB UV 91 was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, a pour point depressant, and an olefin copolymer viscosity index improver.

Example 6

2.0 wt. % of the additive (concentrate) of a functionalized polymer HiTEC® 5777 available from Afton® Corporation and 0.85 wt. % of Propomeen® T12 available from AkzoNobel® was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, a pour point depressant, and an olefin copolymer viscosity index improver.

Comparative Example 1

3.12 wt. % of the additive (concentrate) of a functionalized polymer similar to that described in Example 27 of U.S. Pat. No. 9,115,237 and void of a secondary and/or tertiary amine compound was tested in a fully formulated 5W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

Comparative Example 2

2.0 wt. % of the additive (concentrate) of a functionalized polymer similar to that described in Example 27 of U.S. Pat. No. 9,115,237 and void of a secondary and/or tertiary amine compound was tested in a fully formulated 5W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

Comparative Example 3

2.0 wt. % of the additive (concentrate) of a functionalized ethylene/propylene copolymer grafted with maleic anhydride then reacted with NPPDA with a Mn ∞20,000 and void of a secondary and/or tertiary amine compound was tested in a fully formulated 5W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

Comparative Example 4

2.0 wt. % of the additive (concentrate) of a functionalized polymer similar to that described in Example 27 of U.S. Pat. No. 9,115,237 and void of a secondary and/or tertiary amine compound was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

Comparative Example 5

2.0 wt. % of the additive (concentrate) of a functionalized ethylene/propylene copolymer grafted with maleic anhydride then reacted with NPPDA with a Mn ~20,000 and void of a secondary and/or tertiary amine compound was tested in a fully formulated 10W30 heavy duty diesel oil formulation. The formulation used in this study also contained conventional succinimide dispersants, terpolymer dispersant, overbased calcium and magnesium containing detergents, a phenolic antioxidant, a diphenylamine antioxidant, a molybdenum succinimide antioxidant, zinc dithiophosphate, an ashless friction modifier, a pour point depressant, and an olefin copolymer viscosity index improver.

ISB Engine Test

The formulations from Examples 1-6 and Comparative Examples 1-5 were further tested in a full-length Cummins® ISB engine test (ASTM D7484-11). The Cummins® ISB test is an industry standard Diesel engine durability test using a Cummins® 5.9 L ISB engine. The test is 350 hr and consists of two stages; a 100 hr soot generation stage, followed by a 250 hr cyclic stage to induce valve train wear. Following the test cycle the engine is dismantled and the Cam are analyzed for wear. The Cam wear is reported in average cam scar width ACSW (μm). Pass/fail limits are 55 μm for Cam wear.

TABLE 2

ISB Engine Results

| Example | ACSW (μm) |
|---|---|
| Example 1 | 46.1 |
| Example 2 | 33.3 |
| Example 3 | 13 |
| Example 4 | 18.1 |
| Example 5 | 13.1 |
| Example 6 | 3.1 |
| Comparative Example | 48.5 |

TABLE 2-continued

| ISB Engine Results | |
|---|---|
| Example | ACSW (μm) |
| Comparative Example 2 | 40.3 |
| Comparative Example 3 | 53.4 |
| Comparative Example 4 | 61.6 |
| Comparative Example 5 | 64.8 |

The results shown in Table 2 illustrate a pronounced wear benefit of using a synergistic combination of a dispersant type viscosity modifier and secondary and/or tertiary amine compound on Cam wear in the Cummins ISB Test.

What is claimed is:

1. A method for reducing wear in an internal combustion engine comprising operating the internal combustion engine with an internal combustion engine lubricating oil composition comprising:

A. a major amount of an oil of lubricating viscosity;

B. a dispersant-type olefin copolymer viscosity index improver; and

C. 0.5 to 5 wt. %, based on the total weight of the lubricating oil composition, of a secondary hydrocarbylamine compound, a tertiary hydrocarbylamine compound, or combinations thereof;

wherein the dispersant-type olefin copolymer viscosity index improver comprises the reaction product of:

i. a hydrocarbon polymer grafted with an ethylenically unsaturated acylating agent, wherein the hydrocarbon polymer has a number average molecular weight (Mn) between about 7,000 and about 500,000; and ii. an aryloxy-alkylene amine of the formula Ar—O-Alk-$NH_2$, wherein Ar is an aromatic moiety selected from benzene, naphthylene or anthracene or optionally substituted benzene, optionally substituted naphthylene or optionally substituted anthracene, wherein the optionally substituted groups are selected from 1 to 3 substituent groups selected from alkyl, alkenyl, alkoxy, aryl, alkaryl, arylalkyl, aryloxy, wherein the alkyl group is a straight or branched chain carbon having 6 or less carbon atoms; and -Alk- comprises straight and branched chain alkylene groups having 1 to 10 carbon atoms, which may optionally be substituted with a group consisting of phenyl and benzyl;

or an aryl amine;

wherein the aryl amine is selected from the group consisting of:

a. an N-arylphenylenediamine represented by the formula (1):

(1)

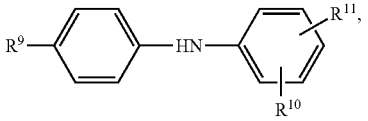

wherein $R^9$ is H, —NHaryl, —NHalkaryl, or a branched or straight chain hydrocarbyl radical having from about 4 to about 24 carbon atoms selected from alkyl, alkenyl, alkoxyl, aralkyl or alkaryl; $R^{10}$ is —$NH_2$, —$(NH(CH_2)_n)_mNH_2$, —NHalkyl, —NHaralkyl, —$CH_2$-aryl-$NH_2$, in which n and m each independently have a value from about 1 to about 10; and $R^{11}$ is hydrogen, alkyl, alkenyl, alkoxyl, aralkyl, or alkaryl, having from about 4 to about 24 carbon atoms;

b. an aminocarbazole represented by the formula (2):

(2)

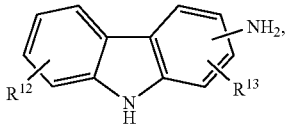

wherein $R^{12}$ and $R^{13}$ each independently represent hydrogen or an alkyl or alkenyl radical having from about 1 to about 14 carbon atoms;

c. an amino-indazolinone represented by the formula (3):

(3)

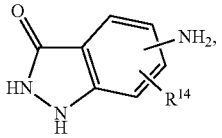

wherein $R^{14}$ is hydrogen or an alkyl radical having from about 1 to about 14 carbon atoms;

d. an aminomercaptotriazole represented by the formula (4):

(4)

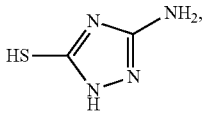

e. an aminoperimidine represented by the formula (5):

(5)

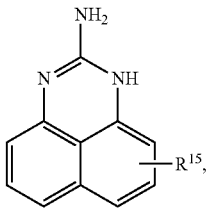

wherein $R^{15}$ represents hydrogen or an alkyl radical having from about 1 to about 14 carbon atoms;

f. an aryloxyphenyleneamine represented by the formula (6):

(6)

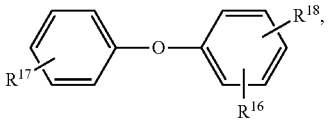

wherein $R^{16}$ is H, —NHaryl, —NHalkaryl, or branched or straight chain radical having from about 4 to about 24 carbon atoms that can be alkyl, alkenyl, alkoxyl, aralkyl or alkaryl; $R^{17}$ is —$NH_2$, —$(NH(CH_2)_n)_m$ $NH_2$, —NHalkyl, or —NHaralkyl, in which n and m each independently have a value from about 1 to about 10; and $R^{18}$ is hydrogen, alkyl, alkenyl, alkoxyl, aralkyl, or alkaryl, having from about 4 to about 24 carbon atoms;

g. an aromatic amine comprising two aromatic groups, linked by a group, L, represented by the following formula (7):

(7)

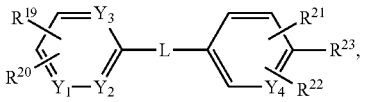

wherein L is selected from —O—, —N═N—, —NH—, —$CH_2$NH, —C(O)$NR^{24}$—, —C(O)O—, —$SO_2$—, —$SO_2NR^{25}$— or —$SO_2$NH—, wherein $R^{24}$ and $R^{25}$ independently represent a hydrogen, an alkyl, an alkenyl or an alkoxy group having from about 1 to about 8 carbon atoms; wherein each $Y_1$, $Y_2$, $Y_3$ and $Y_4$ are independently N or CH provided that $Y_1$ and $Y_2$ may not both be N; $R^{19}$ and $R^{20}$ independently represent a hydrogen, alkyl, aryl, alkaryl, aralkyl, alkoxy, hydroxyalkyl, aminoalkyl, —OH, —$NO_2$, —$SO_3$H, —$SO_3$Na, $CO_2$H or salt thereof, —$NR^{26}R^{27}$ wherein $R^{26}$ and $R^{27}$ are independently hydrogen, alkyl, aryl, arylalkyl, or alkaryl, $R^{21}$ and $R^{22}$ independently represent a hydrogen, an alkyl, an alkenyl or an alkoxy group having from about 1 to about 8 carbon atoms, —OH, —$SO_3$H or —$SO_3$Na, $R^{23}$ represents —$NH_2$, —$NHR^{28}$, wherein $R^{28}$ is an alkyl or an alkenyl group having from about 1 to about 8 carbon atoms, —$CH_2$—$(CH_2)_n$—$NH_2$ or —$CH_2$-aryl-$NH_2$ and n is from 0 to about 10;

h. an aminothiazole selected from the group consisting of aminothiazole, aminobenzothiazole, aminobenzothiadiazole and aminoalkylthiazole;

i. an aminoindole represented by the formula (8):

(8)

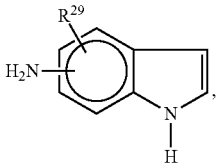

wherein $R^{29}$ represents a hydrogen, an alkyl or an alkenyl group having from about 1 to about 14 carbon atoms;

j. an aminopyrrole represented by the formula (9):

(9)

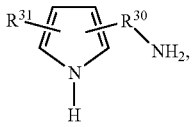

wherein $R^{30}$ represents a divalent alkylene group having about 2 to about 6 carbon atoms, and $R^{31}$ represents a hydrogen, an alkyl or an alkenyl group having from about 1 to about 14 carbon atoms;

k. a ring substituted or unsubstituted aniline;

l. an aminoquinoline;

m. an aminobenzimidazole;

n. a N,N-dialkylphenylenediamine;

o. a benzylic amine;

p. a napthylamine; and q. an aminoanthracene;

wherein the secondary hydrocarbylamine compound is a sterically hindered amine compound represented by a structure of formula (I):

(I)

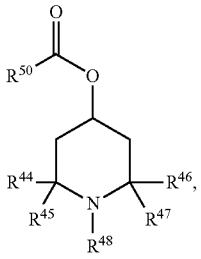

wherein $R^{44}$, $R^{45}$, $R^{46}$ and $R^{47}$ are each independently a hydrocarbyl group having from 1 to 12 carbon atoms, $R^{48}$ is a hydrogen atom, and $R^{50}$ is a hydrocarbyl group having from 1 to 25 carbon atoms; and wherein the tertiary hydrocarbylamine compound is a compound represented by a structure of formula (II):

$$R^{34}R^{35}R^{36}N \quad \text{(II)}$$

wherein at least one of $R^{34}$, $R^{35}$ and $R^{36}$ is a $C_1$-$C_6$ hydrocarbyl group and the other two $R^{34}$, $R^{35}$ and $R^{36}$ are a $C_8$-$C_{20}$ hydrocarbyl group; or an alkyl di-alkanolamine having the following formula (III):

(III)

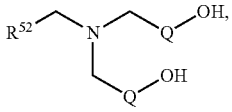

wherein $R^{52}$ has from 6 to 22 carbon atoms and where Q is a $C_1$ to $C_4$ linear or branched alkylene group.

2. The method of claim 1, wherein [C] of the internal combustion engine lubricating oil composition has a weight average molecular weight of from 100 to 1200.

3. The method of claim 1, wherein [C] of the internal combustion engine lubricating oil composition has a TBN value of from 20 to 500 when tested according to ASTM D2896.

4. The of claim 1, wherein the tertiary hydrocarbylamine compound of the internal combustion engine lubricating oil composition is the compound having the following formula:

$$R^{34}R^{35}R^{36}N,$$

wherein at least one of $R^{34}$, $R^{35}$, and $R^{36}$ is a $C_1$-$C_3$ hydrocarbyl group and the other two $R^{34}$, $R^{35}$ and $R^{36}$ are a $C_{12}$-$C_{20}$ hydrocarbyl group.

5. The method of claim 4, wherein, the tertiary amine is selected from the group consisting of dicocoylmethylamine and ditallowmethylamine.

6. The method of claim 1, wherein the tertiary hydrocarbylamine compound of the internal combustion engine lubricating oil composition is an alkoxylated amine.

7. The method of claim 1, wherein the tertiary hydrocarbylamine compound of the internal combustion engine lubricating oil composition is the compound having the following formula:

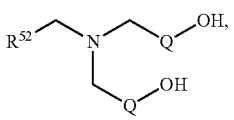

wherein $R^{52}$ has from 8 to 18 carbon atoms; and where Q is a $C_1$ to $C_4$ linear or branched alkylene group.

8. The method of claim 1, wherein in the hindered secondary hydrocarbylamine compound of the internal combustion engine lubricating oil composition having the following formula:

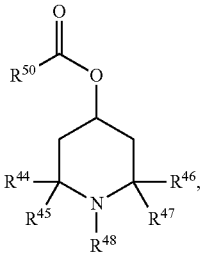

$R^{44}$, $R^{45}$, $R^{46}$ and $R^{47}$ are each independently a hydrocarbyl group having from 1 to 6 carbon atoms and $R^{50}$ is an unsaturated C12-21 hydrocarbyl group.

9. The method of claim 1, wherein the engine wear is cam wear.

10. The method of claim 1, wherein the cam wear is measured according to the Cummins® ISB engine test (ASTM D7484-11).

11. The method of claim 1, wherein the internal combustion engine lubricating oil composition further comprises 1 to 3 wt. %, based on the total weight of the lubricating oil composition, of component (C).

12. The method of claim 1, wherein the internal combustion engine lubricating oil composition further comprises one or more additives selected from the group consisting of an antioxidant, anti-wear agent, detergent, rust inhibitor, dehazing agent, demulsifying agent, metal deactivating agent, friction modifier, pour point depressant, antifoaming agent, co-solvent, corrosion-inhibitor, ashless dispersant, multifunctional agent, dye, extreme pressure agent and mixtures thereof.

13. A method for reducing wear in an internal combustion engine comprising operating the internal combustion engine with an internal combustion engine lubricating oil composition comprising:

(A) a major amount of an oil of lubricating viscosity;

(B) about 0.10 to about 5 wt. %, based on the total weight of the lubricating oil composition, of a dispersant-type olefin copolymer viscosity index improver; and (C) 0.5 to 5 wt. %, based on the total weight of the lubricating oil composition, of a secondary hydrocarbylamine compound, a tertiary hydrocarbylamine compound, or combinations thereof;

wherein the dispersant-type olefin copolymer viscosity index improver comprises the reaction product of:

i. a hydrocarbon polymer grafted with an ethylenically unsaturated acylating agent, wherein the hydrocarbon polymer has a number average molecular weight (Mn) between about 7,000 and about 500,000; and ii. an aryloxy-alkylene amine of the formula Ar—O-Alk-$NH_2$, wherein Ar is an aromatic moiety selected from benzene, naphthylene or anthracene or optionally substituted benzene, optionally substituted naphthylene or optionally substituted anthracene, wherein the optionally substituted groups are selected from 1 to 3 substituent groups selected from alkyl, alkenyl, alkoxy, aryl, alkaryl, arylalkyl, aryloxy, wherein the alkyl group is a straight or branched chain carbon having 6 or less carbon atoms; and -Alk- comprises straight and branched chain alkylene groups having 1 to 10 carbon atoms, which may optionally be substituted with a group consisting of phenyl and benzyl;

or an aryl amine;

wherein the aryl amine is selected from the group consisting of:

a. an N-arylphenylenediamine represented by the formula (1):

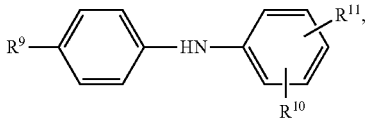

(1)

wherein $R^9$ is H, —NHaryl, —NHalkaryl, or a branched or straight chain hydrocarbyl radical having from about 4 to about 24 carbon atoms selected from alkyl, alkenyl, alkoxyl, aralkyl or alkaryl; $R^{10}$ is —$NH_2$, —$(NH(CH_2)_n)_mNH_2$, —NHalkyl, —NHaralkyl, —$CH_2$-aryl-$NH_2$, in which n and m each independently have a value from about 1 to about 10; and $R^{11}$ is hydrogen, alkyl, alkenyl, alkoxyl, aralkyl, or alkaryl, having from about 4 to about 24 carbon atoms;

b. an aminocarbazole represented by the formula (2):

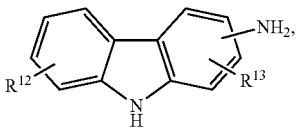

(2)

wherein $R^{12}$ and $R^{13}$ each independently represent hydrogen or an alkyl or alkenyl radical having from about 1 to about 14 carbon atoms;

c. an amino-indazolinone represented by the formula 3):

(3)

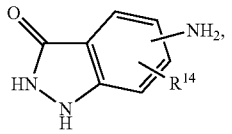

wherein $R^{14}$ is hydrogen or an alkyl radical having from about 1 to about 14 carbon atoms;

d. an aminomercaptotriazole represented by the formula (4):

(4)

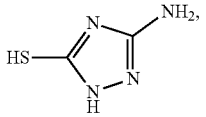

e. an aminoperimidine represented by the formula (5):

(5)

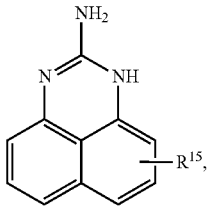

wherein $R^{15}$ represents hydrogen or an alkyl radical having from about 1 to about 14 carbon atoms;

f. an aryloxyphenyleneamine represented by the formula (6):

(6)

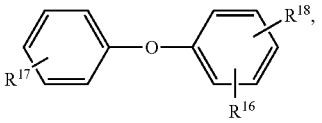

wherein $R^{16}$ is H, —NHaryl, —NHalkaryl, or branched or straight chain radical having from about 4 to about 24 carbon atoms that can be alkyl, alkenyl, alkoxyl, aralkyl or alkaryl; $R^{17}$ is $—NH_2$, $—(NH(CH_2)_n)_m$ $NH_2$, —NHalkyl, or —NHaralkyl, in which n and m each independently have a value from about 1 to about 10; and $R^{18}$ is hydrogen, alkyl, alkenyl, alkoxyl, aralkyl, or alkaryl, having from about 4 to about 24 carbon atoms;

g. an aromatic amine comprising two aromatic groups, linked by a group, L, represented by the following formula (7):

(7)

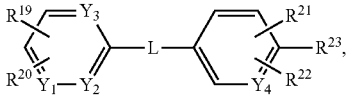

wherein L is selected from —O—, —N═N—, —NH—, $—CH_2NH$, $—C(O)NR^{24}—$, —C(O)O—, $—SO_2—$, $—SO_2NR^{25}—$ or $—SO_2NH—$, wherein $R^{24}$ and $R^{25}$ independently represent a hydrogen, an alkyl, an alkenyl or an alkoxy group having from about 1 to about 8 carbon atoms; wherein each $Y_1$, $Y_2$, $Y_3$ and $Y_4$ are independently N or CH provided that $Y_1$ and $Y_2$ may not both be N; $R^{19}$ and $R^{20}$ independently represent a hydrogen, alkyl, aryl, alkaryl, aralkyl, alkoxy, hydroxyalkyl, aminoalkyl, —OH, $—NO_2$, $—SO_3H$, $—SO_3Na$, $CO_2H$ or salt thereof, $—NR^{26}R^{27}$ wherein $R^{26}$ and $R^{27}$ are independently hydrogen, alkyl, aryl, arylalkyl, or alkaryl, $R^{21}$ and $R^{22}$ independently represent a hydrogen, an alkyl, an alkenyl or an alkoxy group having from about 1 to about 8 carbon atoms, —OH, $—SO_3H$ or $—SO_3Na$, $R^{23}$ represents $—NH_2$, $—NHR^{28}$, wherein $R^{28}$ is an alkyl or an alkenyl group having from about 1 to about 8 carbon atoms, $—CH_2—(CH_2)_n—NH_2$ or $—CH_2$-aryl-$NH_2$ and n is from 0 to about 10;

h. an aminothiazole selected from the group consisting of aminothiazole, aminobenzothiazole, aminobenzothiadiazole and aminoalkylthiazole;

i. an aminoindole represented by the formula (8):

(8)

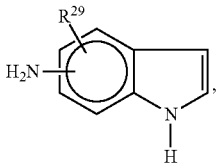

wherein $R^{29}$ represents a hydrogen, an alkyl or an alkenyl group having from about 1 to about 14 carbon atoms;

j. an aminopyrrole represented by the formula (9):

(9)

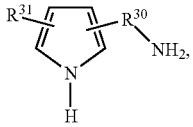

wherein $R^{30}$ represents a divalent alkylene group having about 2 to about 6 carbon atoms, and $R^{31}$ represents a hydrogen, an alkyl or an alkenyl group having from about 1 to about 14 carbon atoms;

k. a ring substituted or unsubstituted aniline;

l. an aminoquinoline;

m. an aminobenzimidazole;

n. a N,N-dialkylphenylenediamine;

o. a benzylic amine;

p. a napthylamine; and q. an aminoanthracene; and wherein the secondary hydrocarbylamine compound is a sterically hindered amine compound represented by a structure of formula (I):

(I)

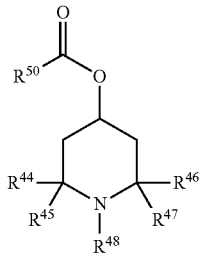

wherein $R^{44}$, $R^{45}$, $R^{46}$ and $R^{47}$ are each independently a hydrocarbyl group having from 1 to 12 carbon atoms, $R^{48}$ is a hydrogen atom, and $R^{50}$ is a hydrocarbyl group having from 1 to 25 carbon atoms; and wherein the tertiary hydrocarbylamine compound is a compound represented by a structure of formula (II):

$$R^{34}R^{35}R^{35}N \quad \text{(II)}$$

wherein at least one of $R^{34}$, $R^{35}$ and $R^{36}$ is a $C_1$-$C_6$ hydrocarbyl group and the other two $R^{34}$, $R^{35}$ and $R^{36}$ are a $C_8$-$C_{20}$ hydrocarbyl group; or an alkyl di-alkanolamine having the following formula (III):

(III)

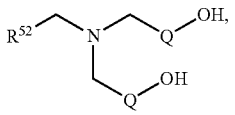

wherein $R^{52}$ has from 6 to 22 carbon atoms and where Q is a $C_1$ to $C_4$ linear or branched alkylene group.

14. The method of claim 13, wherein component (C) of the internal combustion engine lubricating oil composition is the tertiary hydrocarbylamine compound.

15. The method of claim 13, wherein the internal combustion engine lubricating oil composition further comprises one or more additives selected from the group consisting of an antioxidant, anti-wear agent, detergent, rust inhibitor, dehazing agent, demulsifying agent, metal deactivating agent, friction modifier, pour point depressant, antifoaming agent, co-solvent, corrosion-inhibitor, ashless dispersant, multifunctional agent, dye, extreme pressure agent and mixtures thereof.

16. The method of claim 13, wherein the internal combustion engine lubricating oil composition further comprises 1 to 3 wt. %, based on the total weight of the lubricating oil composition, of component (C).

* * * * *